US009663876B2

(12) United States Patent
Masuda et al.

(10) Patent No.: US 9,663,876 B2
(45) **Date of Patent: *May 30, 2017**

(54) SEA-ISLAND COMPOSITE FIBER, MIXED YARN AND FIBER PRODUCT

(71) Applicant: Toray Industries, Inc., Tokyo (JP)

(72) Inventors: Masato Masuda, Mishima (JP); Joji Funakoshi, Otsu (JP)

(73) Assignee: Toray Industries, Inc. (JP)

( * ) Notice: Subject to any disclaimer, the term of this patent is extended or adjusted under 35 U.S.C. 154(b) by 400 days.

This patent is subject to a terminal disclaimer.

(21) Appl. No.: 14/380,496

(22) PCT Filed: Feb. 20, 2013

(86) PCT No.: PCT/JP2013/054228

§ 371 (c)(1),
(2) Date: Aug. 22, 2014

(87) PCT Pub. No.: WO2013/129213

PCT Pub. Date: Sep. 6, 2013

(65) Prior Publication Data

US 2015/0299906 A1 Oct. 22, 2015

(30) Foreign Application Priority Data

Feb. 27, 2012 (JP) ..... 2012-040046
Mar. 26, 2012 (JP) ..... 2012-068939

(51) Int. Cl.

| | |
|---|---|
| ***D01F 8/12*** | (2006.01) |
| ***D01F 8/14*** | (2006.01) |
| ***D01F 8/16*** | (2006.01) |
| ***D02G 3/22*** | (2006.01) |
| ***D01D 5/36*** | (2006.01) |
| *D01F 8/04* | (2006.01) |

(52) U.S. Cl.

CPC ..... *D01F 8/12* (2013.01); *D01D 5/36* (2013.01); *D01F 8/14* (2013.01); *D01F 8/16* (2013.01); *D02G 3/22* (2013.01); *D01F 8/04* (2013.01)

(58) Field of Classification Search

CPC ..... D01D 5/36; D01F 8/04; D02G 3/22
See application file for complete search history.

(56) References Cited

U.S. PATENT DOCUMENTS 9,447,524 B2 * 9/2016 Masuda ..... D01D 5/36

FOREIGN PATENT DOCUMENTS

| | | | |
|---|---|---|---|
| JP | 05-331711 A | | 12/1993 |
| JP | 06-240516 A | | 8/1994 |
| JP | 07-003533 A | | 1/1995 |
| JP | 2007-262610 A | | 10/2007 |
| JP | 2012-127022 A | | 7/2012 |
| KR | 20020095607 A | * | 12/2002 |
| WO | 2011/093331 A1 | | 8/2011 |

OTHER PUBLICATIONS

Translation of KR 2002-0095607, Jun-Yeong Yoon, Dec. 28, 2002, p. 1-11.*

* cited by examiner

*Primary Examiner* — Hai Vo
(74) *Attorney, Agent, or Firm* — DLA Piper LLP (US)

(57) ABSTRACT

A sea-island composite fiber includes two or more kinds of island components having different cross section shapes of which an irregularity difference is 0.2 or more in a same fiber cross section, wherein at least one kind of island component has an irregularity of 1.2 to 5.0 and an irregularity coefficient of variation of 1.0 to 10.0%.

4 Claims, 7 Drawing Sheets

SEA-ISLAND COMPOSITE FIBER, MIXED YARN AND FIBER PRODUCT

TECHNICAL FIELD

This disclosure relates to a sea-island composite fiber, a mixed yarn and a fiber product thereof, the sea-island composite fiber comprising island components and a sea component disposed around the island components in a cross section perpendicular to a fiber axis to be applied to a non-conventional high-performance fabric configured as excellent in quality stability and post-formability.

BACKGROUND

Fibers made from a thermoplastic polymer such as polyester and polyamide are excellent in mechanical properties and dimension stability. Therefore, such fibers are used to manufacture interior accessories, vehicle interior accessories or other industrial products as well as clothing. However, recently, fibers need to have various characteristics according to such various usages. Therefore, techniques are being suggested to provide sensitive effects such as texture and bulkiness to a fiber with a cross section formation. In those techniques, from a viewpoint of controlling a fiber section formation, "making ultrathin fibers" is a mainstream technique having a substantial effect to characteristics of fibers and fabrics made from the fibers.

To make ultrathin fibers, a sole spinning method may achieve only several μm of fiber diameter even if spinning conditions are highly controlled. Therefore, ultrathin fibers are generally made by removing the sea component from sea-island composite fibers made by a composite spinning method. In that technique, a plurality of slightly soluble island components are disposed with soluble sea component in a fiber cross section. The sea component is removed to make the ultrathin fiber comprising the island components after preparing a composite fiber or fiber product. This sea-island spinning technique is often used to manufacture industrial ultrathin fibers such as microfibers in particular. Such a technique is being advanced recently to prepare nanofibers having extreme thinness.

Nanofibers comprising monofilaments which have diameters of several hundreds nm may have a greater material flexibility as well as a greater specific surface area defined as surface area per weight. Therefore, it develops specific characteristics that cannot be achieved by general fibers or microfibers. For example, it is possible that a wiping performance is improved by reducing fiber diameters to increase contact areas and collect dust. In addition, the super specific surface area can improve gas absorption performance, a unique flexible touch (slimy touch) and water absorption performance with microscopic clearances. With such characteristics, nanofibers are used for artificial leathers or textiles having new textures in the apparel field while tight fiber gaps are advantageous to sportswear requiring windbreak and waterproof performance.

However, fabrics made only from nanofibers developing such unique characteristics may be too flexible. Such fabrics may not have a tension or a drape enough to maintain their form. From a viewpoint of mechanical properties, such fabrics can hardly be practically used. Further, nanofibers made from the sea-island composite fibers may have a disadvantage that a processability is greatly reduced in a post process such as weaving process, knitting process and sea-removal process with solvent.

As to those problems, JP 2007-262610 A suggests a mixed yarn consisting of two fibers which have different boiling water shrinkage rates. It is suggested that the mixed yarn should be made by mixing sea-island composite fibers used to prepare ultrathin fibers having an average fiber diameter of 50-1,500 nm together with general fibers having a monofilament fineness of 1.0-8.0 dtex (around 2,700-9,600 nm).

The technique disclosed in JP '610 may improve mechanical properties such as tension and drape, of fabrics relative to another fabric made only from nanofibers by introducing other fibers having greater diameters to contribute the mechanical properties.

However, JP '610 only discloses a technique that the mixed yarn consisting of fibers having greater diameters and sea-island composite fibers is woven and knitted and then subjected to the sea-removal process. With such a technique, the fabric might have greatly biased number density of nanofibers in the cross section direction and the surface direction. As a result, the fabrics disclosed in JP '610 may have a problem that a mechanical property such as tension and drape or a hygroscopicity partially fluctuates. When such a fabric is used to produce clothing such as apparel which directly contacts human skin, the fabric might excessively rub the human skin to unnecessarily damage the skin. Further, the fabric might be wet from sweating to exhibit an unpleasant slimy touch. Thus, the fabric used as a lining cloth to contact human skin may somehow cause an unpleasant feeling.

To prevent a mixed yarn having different fiber diameters from being biased as described above, the sea-island composite fiber can be configured to have island components of different diameters disposed in the sea-island cross section. Such a technique is disclosed in JP '711.

JP '711 suggests a technique about a composite spinneret as an application of sea-island spinneret to form a sea-island composite fiber containing island components having different diameters or section shapes. In that technique, an island component coated with a sea component and another island component uncoated are supplied as a composite polymer flow to a confluence (compression) part in the spinneret. As a result, the island component uncoated with a sea component is fused with adjacent island component to form another island component. This phenomenon randomly occurs to prepare a mixed yarn consisting of thick denier fiber yarns and thin denier fiber yarns. To achieve such a random preparation, the layout of island components and sea component is not controlled in JP '711. Namely, the inserting pressure is controlled to be uniform by a width of flow path provided between separated flow path and introduction hole so that the polymer is discharged from a nozzle at a controlled rate. However, control of the discharging rate may not be sufficient. In other words, to form a nano-sized island component by the technique disclosed in JP '711, the polymer has to be introduced through each introduction hole at the sea component side at a flow rate of only 10-2 g/min/hole to 10-3 g/min/hole. Such a polymer flow rate as an essence of that technique is extremely small and the pressure loss proportional to the polymer flow rate and a wall gap is almost zero. Therefore, controlling the discharging rate may not be sufficient to prevent the nanofiber from having a biased layout. Further, ununiform cross section tends to deteriorate spinnability and might make a partially minimized island component fall off to deteriorate post-formability.

Accordingly, it could be helpful to develop a sea-island composite fiber suitable to prepare a fabric which is excellent in tension and drape with good quality stability and post-formability while hygroscopicity and water absorption performance which are unique to nanofibers are maintained at the same time of preventing a specific slimy touch leading to discomfort.

More particularly, it could be helpful to provide a sea-island composite fiber suitable to prepare a non-conventional high-function fabric excellent in quality stability and post-formability, wherein the sea-island composite fiber consists of two or more kinds of polymers to have a layout of a sea component surrounding island components in a fiber cross section perpendicular to a fiber axis.

SUMMARY

We thus provide:

(1) A sea-island composite fiber comprising two or more kinds of island components having different cross section shapes of which irregularity difference is 0.2 or more in a same fiber cross section, characterized in that at least one kind of island component has an irregularity of 1.2 to 5.0 and an irregularity coefficient of variation of 1.0 to 10.0%.

(2) The sea-island composite fiber according to (1), wherein the at least one kind of island component has an island component diameter of 10 to 1000 nm and an island component diameter coefficient of variation of 1.0 to 20.0%.

(3) The sea-island composite fiber according to (1) or (2), wherein the at least one kind of island component has an irregularity of 1.2 to 5.0, an irregularity coefficient of variation of 1.0 to 10.0%, an island component diameter of 10 to 1000 nm and an island component diameter coefficient of variation of 1.0 to 20.0%.

(4) The sea-island composite fiber according to (1) to (3), wherein an island component diameter difference of the two or more kinds of island components having different cross section shapes is 300 to 3,000 nm.

(5) The sea-island composite fiber according to (1) to (4), wherein first island components (A) having an irregularity of 1.2 to 5.0, an irregularity coefficient of variation of 1.0 to 10.0% and an island component diameter of 10 to 1,000 nm are disposed around a second island component (B) having an island component diameter of 1,000 to 4,000 nm.

(6) A mixed yarn made by removing the sea component from the sea-island composite fiber according to (1) to (5).

(7) A fiber product made from the sea-island composite fiber according to (1) to (5) or the mixed yarn according to (6).

In our sea-island composite fibers, two or more kinds of island components having different cross section shapes of which irregularity difference is 0.2 or more exist in the same cross section, at least one kind of island component having an irregular cross section of which irregularity is 1.2 to 5.0. Once a sea component is removed from the sea-island composite fiber, the fiber comprising the island component having the irregular cross section develops an excellent water absorptive function derived from clearances formed between fibers having different irregularities and are smaller than diameters of the fibers, as well as a hygroscopic function depending on the nanofiber thinness.

In particular, a mixed yarn made from the sea-island composite fiber has a contact area derived from an edged cross section of at least one kind of ultrathin fiber and which is less than that of a general circular cross section, as well as the above-described functions. Therefore, friction develops a smooth touch on the surface of a fabric made of the mixed yarn. Thus, a slimy touch unique to conventional nanofibers can be eliminated. Further, the above-described hygroscopic function and water absorptive function develop a non-conventionally excellent texture such as dry touch to achieve a high-function textile.

The mixed yarn is worthwhile to be applied to industrial materials such as wiping cloth and polishing cloth. The edged part of fiber contacts a surface to be wiped with a high stress by a greatly improved dirt-scraping effect. The dirt scraped off is caught with microscopic clearances between fibers to achieve excellent wiping performance and polishing performance relative to conventional circular cross section.

The irregularity coefficient of variation is 1.0 to 10.0% so that the cross sections have substantively the same formation. Therefore, the whole fabric has uniform characteristics and pressing loads are uniformly applied. Further, the island components exist in the same cross section of the sea-island composite fiber. Therefore, a yarn-mixing post process can be omitted while conventional problem such as "deteriorated post-formability" and "biased island components" can be solved. Thus, a high-function fabric excellent in quality stability and post-formability can be provided.

EXPLANATION OF SYMBOLS

Figure 1:
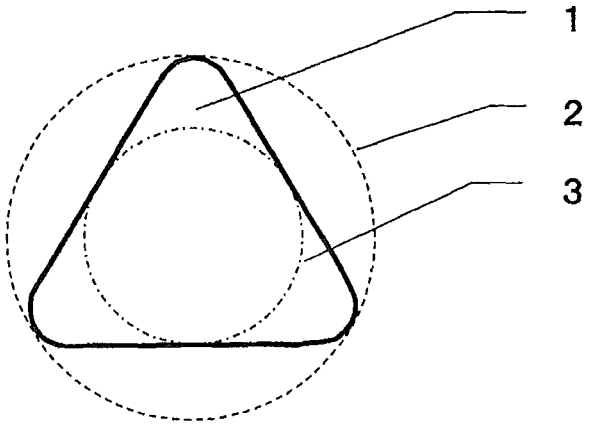
FIG. 1 is a schematic section view showing an example of a cross section shape of an island component.

1: island component
2: circumscribed circle
3: inscribed circle
4: island component A
5: island component B
6: sea component
7: irregularity distribution of island component A
8: irregularity peak value of island component A

9: irregularity distribution width of island component A
10: irregularity distribution width of island component B
11: irregularity peak value of island component B
12: irregularity distribution width of island component B
13: island component diameter distribution of island component A
14: island component diameter peak value of island component A
15: island component diameter distribution width of island component A
16: island component diameter distribution of island component B
17: island component diameter peak value of island component B
18: island component diameter distribution width of island component B
19: island component interval
20: measurement plate
21: distributor plate
22: nozzle plate
23: measurement hole
23-(*a*): polymer A—measurement hole
23-(*b*): polymer B—measurement hole
24: distribution groove
24-(*a*): polymer A—distribution groove
24-(*b*): polymer B—distribution groove
25: distribution hole
25-(*a*): polymer A—distribution hole
25-(*b*): polymer B—distribution hole
25-(*c*): polymer A—enlarged distribution hole
26: discharge introduction hole
27: reduction hole
28: nozzle
29: ring-shaped groove

DETAILED DESCRIPTION

Hereinafter, our fibers, mixed yarns and fiber products will be explained with reference to selected examples.

The "sea-island composite fiber" means a fiber comprising two or more kinds of polymer wherein island components made of a polymer are scattered in a sea component made of another polymer. The sea-island composite fiber is required to have two features. The first feature is that an irregularity of at least one kind of island component is 1.2 to 5.0 while a coefficient of variation of the irregularity is 1.0 to 10.0%. The second feature is that two or more kinds of island components having 0.2 or more of difference between the irregularities exist in the same fiber cross section.

The irregularity is determined as follows.

First, sea-island composite fibers are embedded in an embedding agent such as epoxy resin, and images of the cross section are taken with a transmission electron microscope (TEM) by a magnitude suitable for observing 150 or more pieces of island components. A metal stain causes the island component to have a clear contrast. With each image of the fiber cross section, circumscribed circle diameters are measured for 150 pieces of island components randomly selected in the same image. The circumscribed circle means a true circle circumscribed at two or more points on a cut surface contour as a cross section perpendicular to the fiber axis in a two dimensional image taken. FIG. 1 shows an example of a cross section shape of an island component to explain an irregularity evaluation method. In FIG. 1, circumscribed circle 2 is drawn with a dashed circle. Second, an irregularity is calculated as a ratio of circumscribed circle diameter to inscribed circle diameter, which is to be rounded to one decimal place. The inscribed circle diameter is measured with a true circle inscribed by an island component in a cross section. The inscribed circle means a true circle inscribed at two or more points as many as possible by the cross section of the island component. In FIG. 1, inscribed circle 3 is drawn with a dashed-dotted circle. The irregularity is determined per 150 pieces of island components which are randomly selected in the same image.

The irregularity coefficient of variation is calculated from an average and a standard deviation of the irregularity according to the following formula and then rounded to one decimal place:

Irregularity coefficient of variation (Irregularity $CV$%)=(Standard deviation of irregularity)/(average irregularity)×100[%].

Simple average values of the irregularity and irregularity coefficient of variation are calculated per 10 images taken.

The irregularity is supposed to be less than 1.1 for an island component of which cut surface is shaped in a true circle or an ellipse being similar thereto.

The irregularity may be more than 1.2 with a sea-island composite cross section having the outermost layer shaped in an irregular ellipse if the spinning process is performed with a conventional sea-island composite spinneret. In such a case, the irregularity coefficient of variation may increase to more than 10.0%.

It is possible that at least one kind of island component has 5.0 or more of the irregularity in the sea-island composite fiber. However, a substantive upper limit of the irregularity should be 5.0, in view of practical designing a spinneret to perform this disclosure.

At least one kind of island component has 1.2 to 5.0 of the irregularity in a fiber cross section in the sea-island composite fiber. The irregularity of 1.2 to 5.0 implies "a cross section having a shape other than a circle." Therefore, it is possible that an irregular cross-section fiber generated after the sea-removal process has a much smaller contact area of single island component than a fiber having a circular cross section has. Such a fiber can be used to make a high-function textile fabric which has a comfortably dry texture as well as a glossy appearance that is never found in any fiber having a circular cross section. Also, the sea component can be removed from the sea-island composite fiber to make a wiping cloth or polishing cloth so that an edge part of the cross section exhibits an excellent scraping effect. Thus, sweep and polishing performance can be highly developed. To enhance such advantages compared to a fiber having a circular cross section, it is preferable that the irregularity of the island component is 1.5 to 5.0. It is more preferable that the irregularity of the island component is 2.0 to 5.0 to exhibit a texture entirely different from a circular cross section.

From a viewpoint of minimizing the contact area, it is preferable that the island component having such an irregularity has at least two convex parts in a cross section. Such convex parts provided could improve a dirt-scraping performance leading to the sweep and polishing performance. In the sea-island composite fiber, it is preferable that the island component has a cross section formed in a flat shape like rectangle or in a polygonal shape such as triangle, quadrangle, hexagon and octagon. In particular, it is preferable that the polygonal shape is formed in a regular polygonal shape, which has substantively the same length of sides surrounding the cross section. This is because a regular polygonal shape could orient fibers in the same direction to achieve uniform surface characteristics of the fabric.

The irregularity coefficient of variation is 1.0 to 10.0%.

The irregularity of 1.2 to 5.0 implies "a cross section having a shape other than a circle." Therefore, a contact area and stiffness are different from those of a fiber having a circular cross section to affect on fabric characteristics. Particularly, if the island component having an irregular cross section has a greater irregularity coefficient of variation, the fabric characteristics might be so unstable in quality as to partially fluctuate in an unsatisfactory manner. Therefore, it is important that the irregularity coefficient of variation is maintained within the above described range.

An island component size can be reduced on the order of nano size. If the island component is on the order of nano scale, a specific surface area as a surface area per unit weight is greater than that of microfibers which are generally regarded as ultrathin fibers. Therefore, even a component sufficiently resistant to solvent with which the sea component is removed may have an influence not to be ignored. In such a case, minimization of the irregularity coefficient of variation can make conditions such as temperature and solvent concentration uniform to prevent the island component from partially deteriorating. From a viewpoint of quality stability, the minimized irregularity coefficient of variation of the sea-island composite fiber is greatly advantageous for a fiber (nanofiber) on the order of nano size. In a mixed yarn after a sea-removal process and fiber products made from the mixed yarn, clearances and surface characteristics in the fiber bundle are substantively defined by the island component having 1.2 to 5.0 of irregularity. Therefore, from a viewpoint of quality stability, it is preferable that the irregularity coefficient of variation is less. Particularly in an island component having 1000 nm or less diameter (circumscribed circle diameter), it is preferable that the irregularity is 1.0 to 7.0%. It is more preferable that the irregularity coefficient of variation is 1.0 to 5.0% so that island components have entirely the same shape in the island component group, suitable for a wiping cloth or a polishing cloth capable of performing a sweep process and polishing process with high accuracy.

Figure 2:
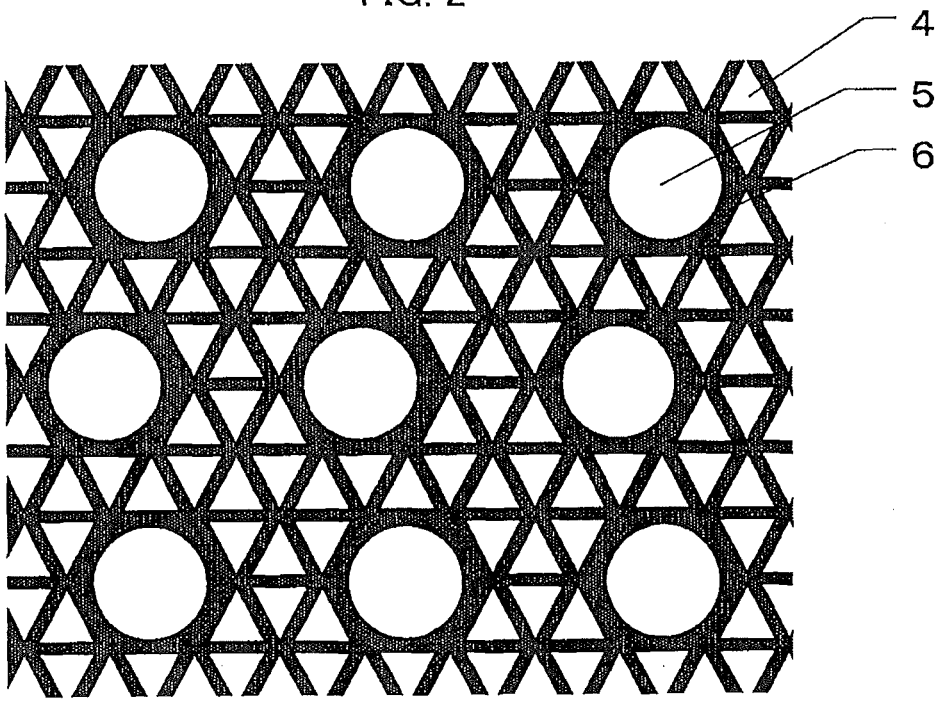
FIG. 2 is a schematic section view showing an example of a cross section of a sea-island composite fiber.

FIG. 2 explains the second feature of the sea-island composite fiber in which "two or more kinds of island components have different cross section shapes of which irregularity difference is 0.2 or more in the same fiber cross section."

Figure 3:
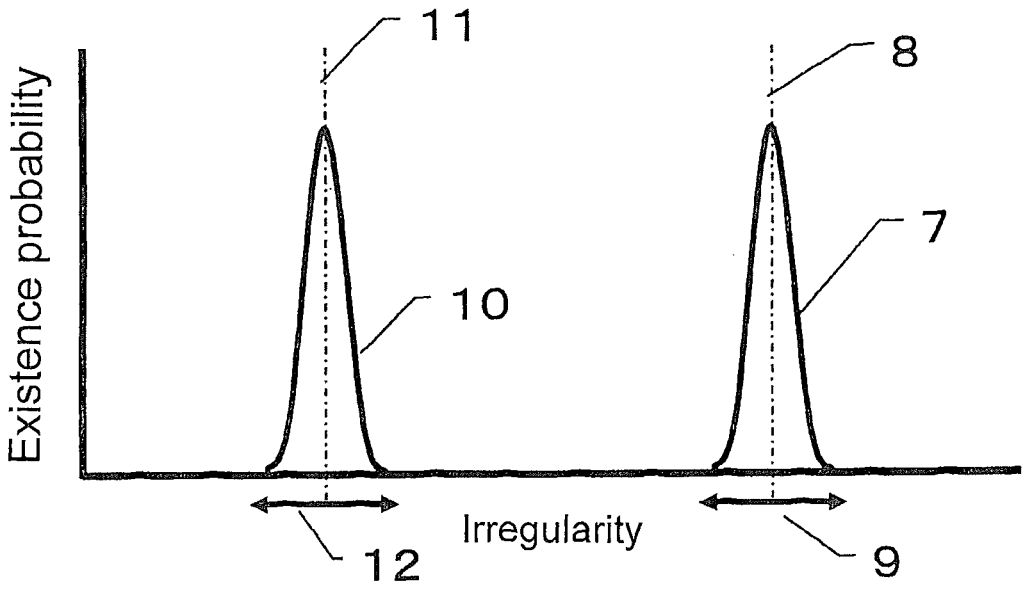
FIG. 3 is a characteristic distribution chart showing an example of irregularity distribution of a sea-island composite fiber.

In FIG. 2, island components A having a greater irregularity (shown with symbol 4) and island components B having a smaller irregularity (shown with symbol 5) are scattered in sea component 6. FIG. 3 shows an example of irregularity distributions 7 and 10 of such a fiber cross section. In FIG. 3, a group of island component having an irregularity within each distribution width 9 or 12 is counted as one group. This specification describes the expression "two or more kinds of island components having different cross section shapes exist in the same fiber cross section" if a cross section of a sea-island composite fiber has two or more groups of island components having such an irregularity distribution.

The distribution width of irregularity shown in FIG. 3 with symbols 9 or 12 means an irregularity width of ±10% irregularity range having each basic point as an existence probability peak (shown in FIG. 3 with symbols 8 and 11) in each group of island components. From another viewpoint of simplified condition of a post process such as sea-removal process, it is preferable that the kind of island component has an irregularity distribution within the peak value ±10% existence probability range. The peak values of island component A and island component B may be close to each other to make their distribution profiles overlap. Such overlapped distributions show that island components having indecisive cross section exist. Such fiber products may be produced if a cross section has to be configured to gradually change. However, it is preferable that each island component has an independent distribution.

The irregularity difference means a difference between peak values (shown in FIG. 3 with symbols 8 and 11) of each island component group. The sea-island composite fiber has an irregularity difference of 0.2 or more. The irregularity difference within such a range shows island components having substantively different shapes of cross section in a sea-island cross section. A fiber bundle comprising fibers having such an irregularity difference has unique clearances between fibers. Therefore, a mixed yarn made from the sea-island composite fiber is supposed to greatly improve in comfortable touch, water absorption, water retainment and dirt collection. Particularly, the "irregularity difference" is greatly effective if the island component has a diameter of 1,000 nm or less. The unique clearances could achieve a synergistic effect with the water absorption and water retainment which are essential in nanofibers. The unique clearances can be controlled based on the irregularity difference. Therefore, fabric characteristics can desirably be controlled. The irregularity difference can be set according to a target fiber product and its required characteristics. The greater irregularity difference tends to generate a non-conventional high-function textile. Therefore, it is preferable that the irregularity difference is 0.5 or more, preferably 1.0 or more. From a viewpoint of design difficulty of composite spinnerets to be described later, a substantive upper level of the irregularity difference is 4.0.

It is important that two or more kinds of the island components having different cross section shapes exist in the same cross section of sea-island composite fiber. Conventional techniques of the yarn-mixing post process as disclosed in JP '610 may have a problem that fibers having an irregular cross section have a partially biased fiber existence probability in a fabric cross section.

The sea-island composite fiber is woven and knitted to make a fabric as keeping each island component at each original position of the sea-island composite fiber. In the sea-removal process, shrunk fibers (island component) are physically caught to almost keep an original positional relation of fibers having different cross section shapes even after the sea component is removed. Thus, "biased fiber existence" as a conventional problem can greatly be prevented. Particularly, because the island components have different cross section shapes fibers naturally tend to have biased existence probability. Therefore, the feature "island components having different cross section shapes exist in the same fiber cross section" is effectively important to improve quality stability. From an industrial viewpoint, it is advantageous that the yarn-mixing post process can be omitted. In a conventional art in which two characteristically different fibers are mixed, the yarn mixing process might have a risk of yarn breakage or the like because different stresses are applied to different fibers. This is because the yarn mixing process is performed at room temperature so that fibers have different elongation at break (plasticity) in deformation. Even if the yarn mixing process is performed with a heating roller or the like to prevent such a plastic deformation, the yarn breakage effect might not be sufficient because of different softening points. As a result, each mixed yarn made from fibers having different history in a spinning process is supposed to have a different shrinkage rate as disclosed in JP '610. Therefore, a fabric having partially uneven grammages is obtained generally in a sea-removal process performed at a heated atomosphere although the above-described biased fibers also contribute thereto. As a result, a fabric might break in the sea-removal process. On the other hand, the sea-island composite fiber has an integrated fiber assembly capable of smoothly passing through post processes such as weaving, knitting and sea-removal processes so that the spinning process histories have no difference. Therefore, processability of postprocessing (post-formability) can be greatly improved without different shrinkage behaviors and conventional problems.

The above-described features "two or more kinds of island components having different cross section shapes exist in the same fiber cross section" and "at least one kind of island component has an irregularity of 1.2 to 5.0 and an irregularity coefficient of variation of the irregularity is 1.0 to 10.0%" are particularly advantageous if the sea-island composite fiber is applied to mixed yarns comprising nanofibers and fiber products made from the mixed yarn. Therefore, it is preferable that at least one kind of island component has an island component diameter of 10 to 1,000 nm while the island component has a island component diameter coefficient of variation of 1.0 to 20.0%.

The diameter of the island component (island component diameter) means a diameter (circumscribed circle diameter) of a true circle circumscribed on a cut surface contour as a cross section perpendicular to a fiber axis in a two dimensional image taken. The island component diameter is determined per 150 pieces of randomly selected island components in a cross section image of the sea-island composite fiber in the same way of the above-described irregularity evaluation method. Thus, measured island component diameter is rounded to the closest whole number by nm unit. The island component diameter coefficient of variation is calculated from a measurement result of the island component diameters according to the following formula, and then is rounded to one decimal place:

Island component diameter coefficient of variation (Island component diameter $CV$%)=(Standard deviation of island component diameter)/(Average island component diameter)×100[%].

Simple average values of the island component diameter and island component diameter coefficient of variation are calculated per 10 images taken.

In the sea-island composite fiber, it is possible that the island component diameter of the island component having an irregular cross section is less than 10 nm. However, in the sea-island composite fiber, it is preferable that the island component diameter is equal to or more than 10 nm so that conditions of processes such as sea-removal process and partial cutting in a spinning process are easily designed. On the other hand, it is preferable that nanofiber's unique characteristics such as flexibility, texture, water absorption, water retainment, sweep performance and polishing performance are utilized to obtain a non-conventional high-function mixed yarn or a fabric made from the mixed yarn. Therefore, it is preferable that at least one kind of island component has an island component diameter of 1,000 nm or less.

To enhance such advantages of the nanofiber's unique function, it is preferable that the island component diameter is 700 nm or less. From the viewpoint of fluent processability of postprocessing, simple sea-removal condition setting and handling ability of fiber products, it is preferable that the lower limit of the island component diameter is 100 nm. Therefore in the sea-island composite fiber, it is particularly preferable that at least one kind of island component has an island component diameter of 100 to 700 nm.

It is preferable that the island component having a diameter of 10 to 1,000 nm formed in the sea-island composite fiber has an island component diameter coefficient of variation of 1.0 to 20.0%. The island component having an island component diameter of 1,000 nm or less has an extremely small diameter so that a specific surface area as a surface area per weight is greater than that of general fibers or microfibers. Therefore, the island component, even if sufficiently resistant to solvent with which the sea component is removed, may have an influence of being exposed to the solvent not to be ignored. In such a case, minimization of the island component diameter coefficient of variation can make uniform conditions such as temperature and solvent concentration in the sea-removal process, to prevent the island component from partially deteriorating. From the viewpoint of quality stability, the minimized island component diameter coefficient of variation could prevent characteristics of mixed yarns or fabrics made from the mixed yarns from fluctuating. In addition, the above-described synergistic effect to prevent a harmful influence caused by the solvent can be achieved. Therefore, the minimized island component diameter coefficient of variation can provide extremely high-quality fiber products. From the viewpoint of quality stability and simple designing of post process conditions such as sea-removal condition, it is preferable that the island component diameter coefficient of variation is less, and is particularly 1.0 to 10.0%.

As described above, it is possible that the sea-island composite fiber has an island component of which island component diameter is minimized. If the minimized island component has an irregular cross section having a certain irregularity, the nanofibers surprisingly develop a comfortably dry textile although general nanofibers develop a slimy touch only. Therefore, fabrics made from the sea-island composite fiber can be a high-function textile having a new sense of comfortable touch. Such a new sense of texture can be developed in the sea-island composite fiber if at least one kind of island component has an irregularity of 1.2 to 5.0, an irregularity coefficient of variation of 1.0 to 10.0%, an island component diameter of 10 to 1000 nm and an island component diameter coefficient of variation of 1.0 to 20.0%. A wiping cloth or polishing cloth made from the sea-island composite fiber satisfying such requirements is supposed to have a scraping effect by edge parts of the cross section as well as the minimized fiber diameter to achieve a superhigh sweep and polishing performance that has never been achieved. To enhance such characteristics and improve a quality stability in the sea-island composite fiber, it is preferable that at least one kind of island component has an irregularity of 1.2 to 5.0, an irregularity coefficient of variation of 1.0 to 10.0%, an island component diameter of 100 to 700 nm and an island component diameter coefficient of variation of 1.0 to 10.0%.

Figure 4:
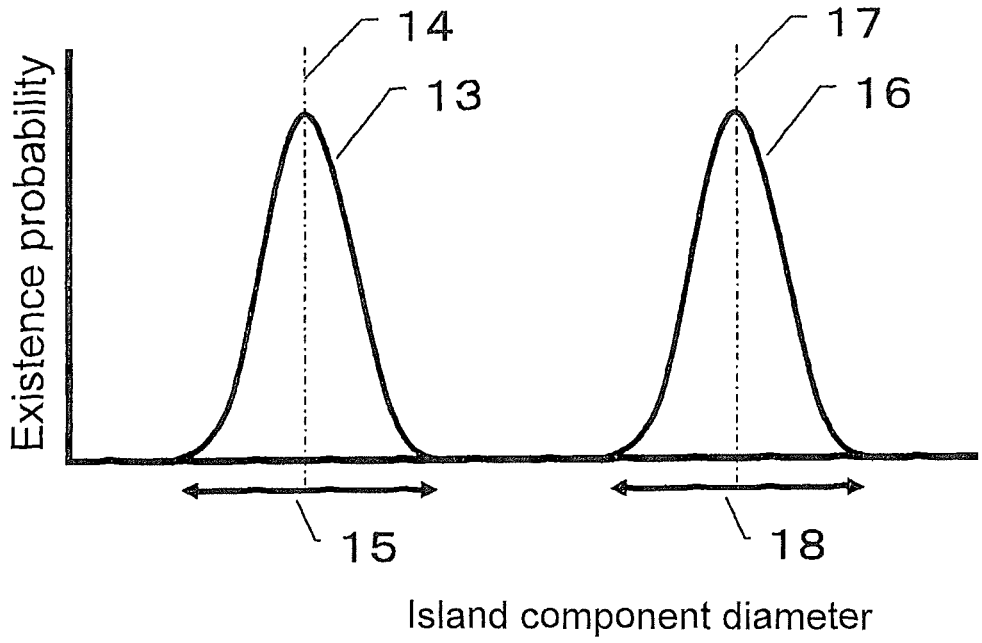
FIG. 4 is a characteristic distribution chart showing an example of island component diameter distribution of a sea-island composite fiber.

From the viewpoint of material design of fiber products, it is preferable that two or more kinds of island components having different diameters exist in the same cross section so that the sea-island composite fiber is a mixed yarn which is excellent in mechanical properties and unique functions of nanofibers having irregular cross sections. This feature represents a concept that fibers having a greater fiber diameter are disposed without biased existence probability so that the fibers having a greater fiber diameter contribute to mechanical properties of the mixed yarn and fabrics made from the mixed yarn while the fibers having a smaller fiber diameter and an irregular cross section contribute to texture, water absorption, water retainment, sweep performance and polishing performance. To achieve such a concept, it is preferable that a diameter difference (island component diameter difference) of the island components (group) is 300 nm or more. This is because the fibers designed to have a greater fiber diameter are substantively expected to contribute to mechanical properties of fabrics. Therefore, the fiber having a greater diameter preferably has a stiffness definitely higher than that of another fiber designed to have a smaller fiber diameter. Thus, being focused on a second moment area implying a material stiffness, the island component diameter difference should be 300 nm or more to definitely increase the second moment area proportional to the fourth power of fiber diameter. On the other hand, if the island component diameter difference increases to definitely increase the stiffness difference between island component groups when at least one kind of island component has a diameter on the order of nano size, the specific surface area increasing to affect a processing speed with respect to the solvent should be cared. Therefore, it is preferable that the island component diameter difference is 3,000 nm or less, from a viewpoint of improved quality stability. Thus, considering further, it is preferable that the island component diameter difference is less, and is concretely 2,000 nm or less, preferably 1,000 nm or less. The island component diameter difference is depicted as the difference between peak values (shown in FIG. 4 with symbols 14 and 17) of the island component diameter distribution profile shown in FIG. 4.

In addition to setting the island component diameter difference to the above-described range to consider fiber product designs, it is preferable that island components (island component A) having irregularities with island component diameters on the order of nano size are regularly disposed around island components having greater island component diameters in a cross section of the sea-island composite fiber. The sea-island composite fiber having such a layout is subjected to the sea-removal process to simulate tangled fibers (mixed yarns) in which fibers having smaller diameters with irregular cross sections approach fibers having greater diameters. The mixed yarn and a fabric made from the mixed yarn have advantage in mechanical properties and uniform surface characteristics as well as improved unique texture because of uniform orientation of nanofibers having irregular cross sections. Such a simulated tangled structure prevents nanofibers from breaking and falling off even if loads such as abrasion are applied repeatedly. Thus, the mixed yarn or fabric made from the mixed yarn improves in durability and processability of postprocessing.

Considering fiber product designs, it is preferably configured to have a core-sheath structure in which sheath component fibers (island component A) having irregularities with fiber diameters on the order of nano size are regularly disposed around core component fibers (island component B) having greater fiber diameters. This is because the mixed yarn and a fabric made from the mixed yarn have advantage in mechanical properties and uniform surface characteristics as well as improved unique texture because of uniform orientation of nanofibers having irregular cross sections. Because such a simulated tangled structure prevents nanofibers from breaking and falling off even if loads such as abrasion are applied repeatedly, the mixed yarn or fabric made from the mixed yarn improves in durability and processability of postprocessing.

The core-sheath structure means a structure in which fibers (island component A) having irregularities with smaller fiber diameters are regularly disposed around fibers having greater fiber diameters in a cross section. It is preferable that a sea-island cross section is preformed as shown in FIG. 2 so that the core-sheath structure is formed after the sea-removal process. Such a preformed cross section as shown in FIG. 2 changes into a structure in which fibers (island component A) having smaller fiber diameters and fibers having greater fiber diameters are regularly disposed in a cross section if the sea component (shown in FIG. 2 with symbol 6) is eluted. In FIG. 2, island component B is depicted as a fiber having a circular cross section. Alternatively, the fiber of island component B may have an irregular cross section (irregularity: 1.2 to 5.0) in other designs of fabric characteristics and fiber products.

Additionally, a color development improvement has been found with the mixed yarn and fabric made from the mixed yarn which have been prepared by removing a sea component from the sea-island composite fiber having a layout of island components A disposed regularly around island components B. Such an improved characteristic can solve one of the problems for applying nanofiber products to clothing. Particularly, it is important that nanofibers can be applied to outer materials of high-performance sports clothing and women's clothing that prefer colorful fabrics.

Because nanofibers have fiber diameters close to wavelengths of visible light, the surface of nanofiber diffusely reflects or transmits the light to exhibit a poor color development with white blurring on fabric comprising nanofibers. Therefore nanofibers are usually used for industrial materials having less requirement of coloring or used for inner materials of clothes with its unique texture. On the other hand, the sea-island composite fiber provides a mixed yarn comprising nanofibers simulated to entangle with fibers having greater fiber diameters from regularly disposed island components. Therefore, even if nanofibers on the outer layer don't contribute to coloring, the fibers having greater diameters contribute coloring to greatly improve color development in a state of mixed yarn. Such an improvement can be observed as a clear advantage in fabrics provided. Particularly, color development is achieved efficiently by uniformly disposed fibers having greater fiber diameters or nanofibers. In the sea-island composite fiber, it seems that color development is improved by a simulated porous structure made of nanofibers having uniform cross sections with a certain irregularity around the fibers having greater fiber diameters. Such a tendency can be achieved by our sea-island composite fiber. Conventional fabrics having a biased fiber distribution might have uneven color development with longitudinal streaks.

To provide a mixed yarn or fabric made from the mixed yarn with the above-described color development and unique function of nanofiber, it is preferable that an irregularity is 1.2 to 5.0 and an irregularity coefficient of variation is 1.0 to 10.0%, wherein island components A having island component diameters of 10 to 1,000 nm are disposed around island components B having island component diameters of 1,000 to 4,000 nm. From the viewpoint of settlements of island component A and island component B at the sea-removal process as well as a simplified setting of the sea-removal condition, it is preferable that island component B has an island component diameter of 1,500 to 3,000 nm. The layout in which island components A are disposed around island components B means that island components A are regularly disposed around by 360 degrees from the center of island component B without being adjacent to island component B, as shown in FIG. 2.

Figure 5:
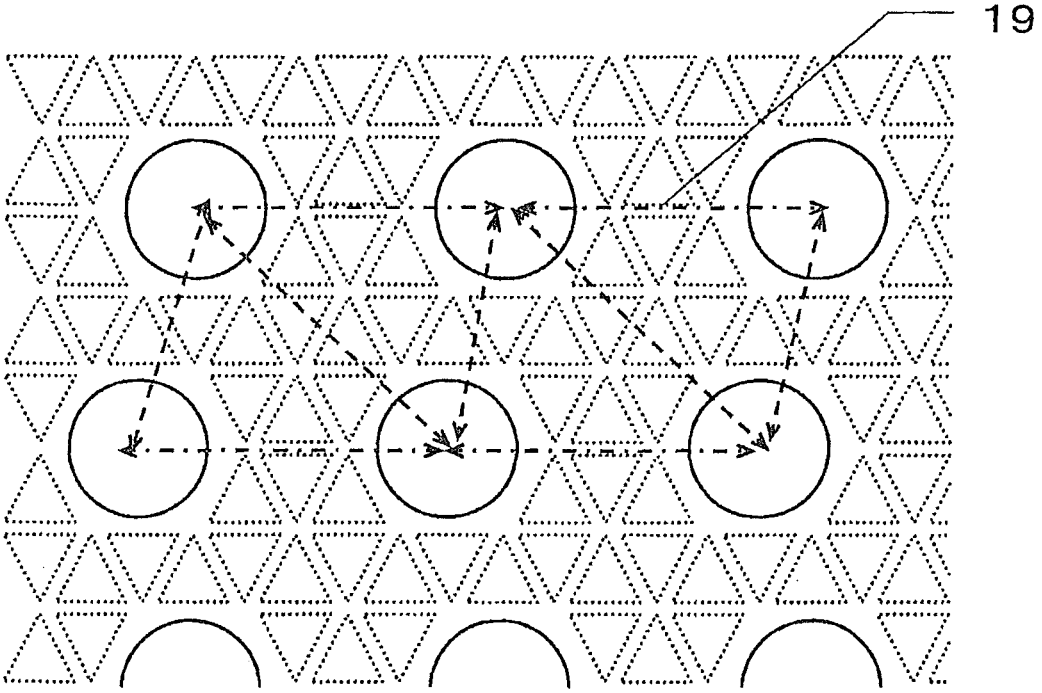
FIG. 5 is a schematic section view showing an example of a cross section of a sea-island composite fiber for explaining intervals between island components.

Concerning uniformity of the mixed yarn made from the sea-island composite fiber, it is preferable that components B are fixed (restricted) uniformly. Namely, even the uniformity of sea component (interval between island components) should be cared. Therefore, it is preferable that island components B are disposed at an equal interval in the cross section. Specifically, it is preferable that an island component interval coefficient of variation defined as a coefficient of variation of intervals (shown in FIG. 5 with symbol 19) between centers of island components B is 1.0 to 20.0%. From the viewpoint of improved color development in the mixed yarn or fabric made from the mixed yarn, it is preferable that the island component interval coefficient of variation is smaller, and is specifically 1.0 to 10.0%. The island component interval coefficient of variation is determined with a two dimensional sea-island composite fiber cross section image taken in a way similar to the above-described determination of the island component diameter and the island component diameter irregularity. With the image, the distance shown in FIG. 5 with symbol 19 between centers of adjacent island components B is measured. The distance is regarded as an island component interval coefficient of variation (island component interval CV %) to be calculated from an average island component interval and a standard deviation. The island component interval coefficient of variation is a value calculated by the formula of (standard deviation of island component interval)/(average island component interval)×100 [%] and then rounded to one decimal place. Simple average values of the island component interval coefficient of variation are calculated per 10 images in the same way of other cross section formation evaluation.

To control the processability of a post process required to produce a fiber product from the sea-island composite fiber, the sea-island composite fiber preferably has a predetermined toughness. Specifically, it is preferable that the sea-island composite fiber has a tensile strength of 0.5 to 10.0 cN/dtex and an elongation at break of 5 to 700%. The tensile strength is a value obtained by dividing a breaking load by an initial fineness with a load-elongation at break profile of multifilaments determined according to JIS L1013 (1999). The elongation at break is a value obtained by dividing a breaking length by an initial sample length. The initial fineness is a value calculated from obtained fiber diameter, the number of filaments and density, or alternatively is a weight per 10,000 m calculated from a simple average weight per unit fiber length measured several times. It is preferable that the tensile strength of the sea-island composite fiber is 0.5 cN/dtex or more so that the processability of postprocessing is practical. The actual upper level of the tensile strength is 10.0 cN/dtex. From the viewpoint of processability of postprocessing, it is preferable that the elongation at break is 5% or more, and the actual upper level is 700%. The tensile strength and elongation at break can be adjusted by controlling producing conditions depending on a target use.

To produce general clothes such as inner or outer wear with a mixed yarn made from the sea-island composite fiber, it is preferable that the tensile strength is 1.0 to 4.0 cN/dtex and the elongation at break is 20 to 40%. To produce sportswear to be used in hard environments, it is preferable that the tensile strength is 3.0 to 5.0 cN/dtex and the elongation at break is 10 to 40%.

To produce industrial materials such as wiping cloth and polishing cloth, it should be noted that those clothes are rubbed against an object as being pulled down with weight applied. To prevent the mixed yarn from breaking and falling off while wiping the object, it is preferable that the tensile strength is 1.0 cN/dtex or more and the elongation at break is 10% or more.

It is possible that the sea-island composite fiber is processed into various intermediates such as fiber rewind package, tow, cut fiber, floss, fiber ball, cord, pile, textile and nonwoven fabric, and then a sea component is removed therefrom to make a mixed yarn for various fiber products. To produce fiber products, it is even possible that the sea component is removed partially from the sea-island composite fiber or alternatively island components are removed from the sea-island composite fiber. The fiber products may be a general clothing such as jackets, skirts, pants and underwear, sports clothing, clothing material, an interior product such as carpet, sofas and curtains, vehicle interior equipment such as car seat, a living ware such as cosmetics, cosmetic masks, wiping cloth and health equipment, an environmental or industrial material such as polishing cloth, filters, toxic substance removal products and battery separators, or a medical product such as suture thread, scaffolds, artificial blood vessels and blood filters.

Hereinafter, a production method of a sea-island component will be explained in detail.

A sea-island composite fiber comprising two or more kinds of polymer can be spun to produce a sea-island composite yarn. From the viewpoint of enhanced productivity, it is preferable that the sea-island composite fiber is melt spun to make the sea-island composite yarn. Alternatively, it is even possible that the sea-island composite fiber is subjected to a solution spinning. From the viewpoint of excellent control of a fiber diameter and cross section shape, it is preferable that the spinning process is performed with a sea-island composite spinneret.

With a conventional pipe-shaped sea-island composite spinneret, it is difficult that the sea-island composite fiber is spun to control a cross section shape of the island component. To produce a sea-island composite yarn, it is necessary to control the flow rate from $10^{-1}$ g/min/hole to $10^{-5}$ g/min/hole with much less digit than a conventional art has. To form an island component having an irregular cross section other than a true circle to meet the requirement of irregularity coefficient of variation, it is preferable that a sea-island composite spinneret as shown in FIG. 6 is employed.

Figure 6:
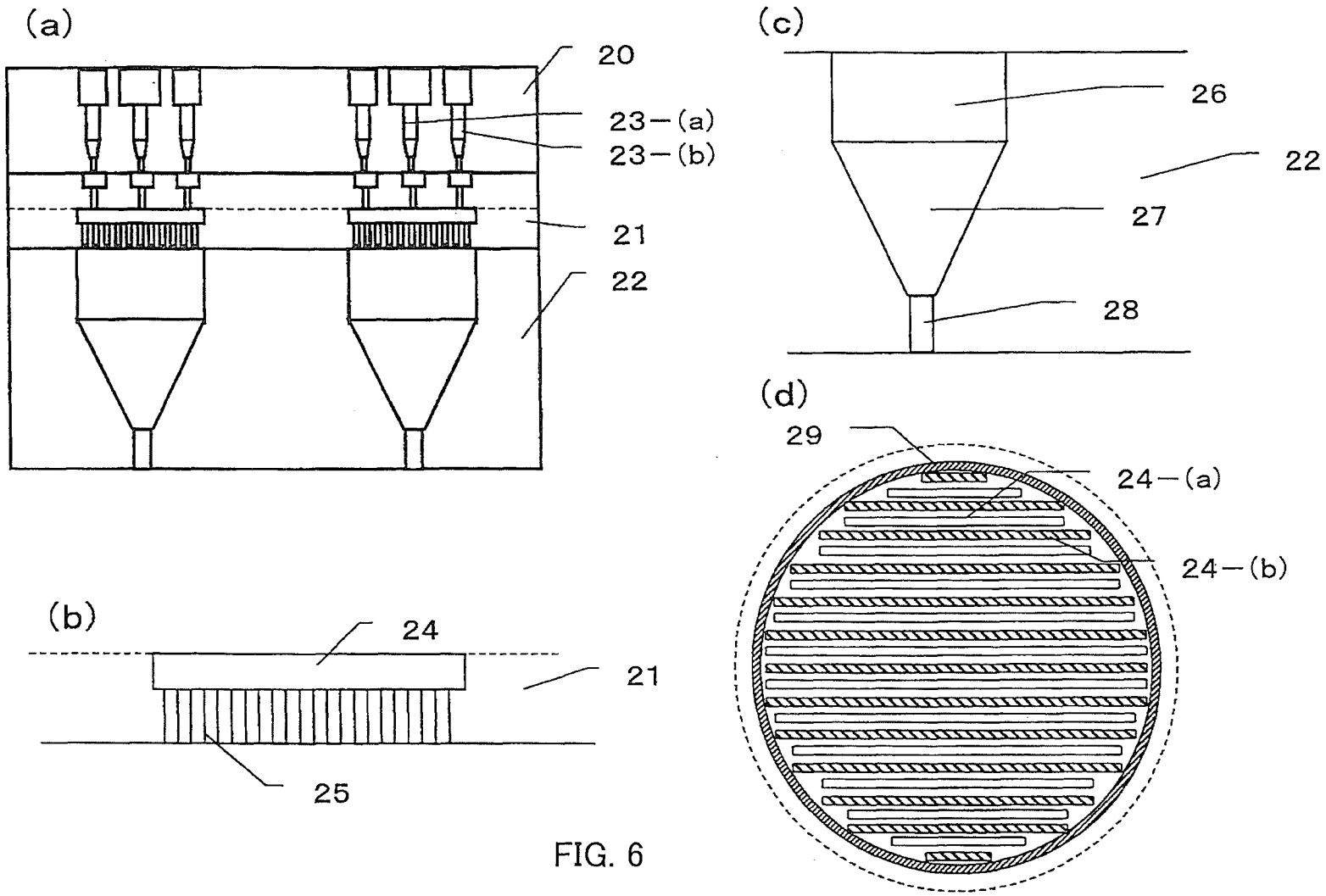
FIGS. 6 (*a*)-(*d*) are schematic diagrams showing an example of a composite spinneret for producing a sea-island composite fiber, where (a) is a side view of a main part constituting the composite spinneret, (b) is a side view of a part of a distributor plate, (c) is a side view of a nozzle plate and (d) is a plan view of a part of the distributor plate.

The composite spinneret shown in FIG. 6 having a roughly three-storied spinning pack, which incorporates measurement plate 20, distributor plate 21 and nozzle plate 22, is used to perform a spinning process. FIG. 6 shows an example of the spinning pack for spinning two kinds of polymers of polymer A (island component) and polymer B (sea component). To make a mixed yarn consisting of island components by removing a sea component from a sea-island composite fiber, slightly soluble island component and easily soluble sea component should be employed. If needed, it is possible that another polymer is used together with the slightly soluble component and the easily soluble component to perform a spinning process. Such island components each having different slight solubility can achieve characteristics that could not be achieved by a mixed yarn consisting of a single polymer. It is difficult that a conventional pipe-shaped composite spinneret is employed for such a composite technique using three or more kinds of polymers. Therefore, the composite spinneret having thin flow paths as shown in FIG. 6 is preferably employed.

In the spinneret member as shown in FIG. 6, measurement plate 20 measures an inflow polymer quantity per each nozzle 28 and distribution holes for both components of sea and island, distributor plate 21 controls a cross section shape of monofilament (sea-island composite monofilament) including a sea-island composite cross section and an island component cross section, and nozzle plate 22 compresses a composite polymer flow which has been formed through distributor plate 21 and is discharged. It is possible that another member having inner flow paths designed to fit the spinning machine and spinning pack is stacked on top of measurement plate 20. If the measurement plate is designed to fit a conventional flow path member, a conventional spinning pack and its component members can be utilized. With such a composite spinneret, a conventional spinning machine can be used as is. It is preferable that a plurality of stacked flow path plates are provided between the flow path member and measurement plate 20 or between measurement plate 20 and distributor plate 21. Such a configuration makes it possible that polymer is introduced into distributor plate 21 through efficient flow paths in a spinneret cross section direction as well as a monofilament cross section direction. According to a conventional melt spinning method, the composite polymer flow discharged from nozzle plate 22 is cooled to be solidified and then oil is added to. Thus, the composite polymer is rewound with a roller rotating at a regular circumferential speed to produce a sea-island composite fiber.

An example of the composite spinneret will be explained with FIG. 6-FIG. 7 in more details.

FIGS. 6 (*a*)-(*d*) are schematic diagrams showing an example of a composite spinneret that we use. FIG. 6 (*a*) is a side view of a main part composing the composite spinneret, FIG. 6 (*b*) is a partial side view of distributor plate 21, FIG. 6 (*c*) is a partial side view of nozzle plate 22 and FIG. 6 (*d*) is a plan view of distributor plate 21. FIGS. 7 (*a*)-(*c*) are schematic plan views showing enlarged parts of distributor plate 21. Each plan view of grooves and holes relates to one nozzle.

Hereinafter, polymer flows through the composite spinneret as shown in FIG. 6 will be explained down the stream. Polymers are flowed through measurement plate 20 and distributor plate 21 to make a composite flow to be discharged from nozzles of nozzle plate 22.

From the upstream of the spinning pack, polymer A and polymer B flow into polymer A measurement hole 23-(*a*) and polymer B measurement hole 23-(*b*) of measurement plate 20. The polymers measured with throttle holes perforated at the bottom ends are flowed into distributor plate 21. Polymer A and polymer B are measured by pressure losses at throttles provided in each measurement hole. The throttles are designed to have a target pressure loss of 0.1 MPa or more. On the other hand, to prevent the pressure loss from becoming excessive to deform a member, it is preferable that the target pressure is 30.0 MPa or less. The pressure loss is decided by the inflow rate and viscosity of polymer per measurement hole. For example, if the melt spinning process is performed with a polymer, which has a viscosity of 100 to 200 Pa·s at 280° C. and distortion speed of 1,000 $s^{-1}$, at a spinning temperature of 280 to 290° C. and a through-put rate of 0.1 to 5.0 g/min per measurement hole, the throttle having a hole diameter of 0.01 to 1.00 mm and an L/D (nozzle length/nozzle diameter) of 0.1 to 5.0 can achieve a good measurement in discharging. If the melt viscosity of polymer is less than the above-described range or if each hole has a decreased through-put rate, the hole diameter should be decreased close to the lower limit or the hole length should be increased close to the upper limit. On the contrary, for high viscosity or increased through-put rate, the hole diameter and hole length should be adjusted oppositely.

It is preferable that measurement plates 20 are stacked to measure the polymer stepwise, as being preferably provided with 2 to 10 stages of measurement holes. To control the flow rate from 10-1 g/min/hole to 10-5 g/min/hole with much less digit than a conventional art has, it is preferable that the plurality of measurement plates are stacked or that the plural stages of measurement holes are provided. From the viewpoint of preventing an excessive pressure loss per spinning pack and a reduced detention time or abnormal detention possibility, it is preferable that the measurement plates are stacked into 2 to 5 stages.

Each measurement hole 23 (23-(*a*) and 23-(*b*)) discharges a polymer to be flowed into distribution grooves 24 of distributor plate 21. To improve a stability of a sea-island composite cross section, it is preferable that polymer A and polymer B are spread in a cross section direction in advance of flowing into the distributor plate through flow paths which gradually extend the groove length in the cross section direction down the stream by providing grooves of the same numbers as measurement holes 23 between measurement plate 20 and distributor plate 21. It is preferable that each flow path has a measurement hole as described above.

Distributor plate 21 has distribution grooves 24 to detain a polymer flowed in through measurement holes 23 and has distribution holes 25 through which the polymer flows downstream under distribution grooves 24. It is preferable that distribution groove 24 has a plurality of distribution holes. It is preferable that a plurality of distributor plates 21 are stacked to repeatedly perform partial joining and distributing of each polymer individually. With such a design of repetitive flow paths (distribution holes 25—distribution groove 24—distribution holes 25), a polymer can flow into other distribution hole 25 even if one of the distribution holes is blocked. Therefore, even if distribution hole 25 is blocked distribution groove 24 downstream is filled with another flow. Repetitive configurations where one distribution groove 24 has a plurality of distribution holes 25 make it possible for a polymer supposed to flow into a blocked distribution hole 25 to flow into another hole without any substantively bad effect. Further, such distribution groove 24 can prevent viscosities from being uneven because some portions of polymer which has flowed through various flow paths to obtain thermal histories are joined some times. With such a design of repetitive flow paths (distribution holes 25—distribution groove 24—distribution holes 25), the downstream distribution grooves may be inclined at 1 to 179° circumferentially to the upstream distribution grooves so that polymer portions flowing through different upstream distribution grooves 24 are joined in the downstream distribution groove. Such flow paths can make polymer portions having obtained different thermal histories or the like join together some times so that the sea-island composite cross section is controlled effectively. From the viewpoint of the above-described purpose, it is preferable that such a mechanism of the joining and distribution is installed upstream, and is preferably installed in measurement plate 20 or its upstream member. It is preferable that a plurality of distribution holes 25 are provided per single distribution groove 24 so that the polymer portions are divided efficiently. From the viewpoint of simple design of spinneret and minimum control of polymer flow rate, it is preferable that distributor plate 21 being immediately upstream of nozzles has 2 to 4 holes of distribution holes 25 per single distribution groove 24.

Such structured composite spinneret makes a polymer flow always stabilized to produce a highly accurate sea-island composite fiber comprising extremely many island components. The number (the number of islands) of distribution holes 25-(*a*) and 25-(*c*) per single nozzle is not limited theoretically within the space permitted. It is substantively preferable that the number of islands is 2 to 10,000. To easily meet the requirement of the sea-island composite fiber, it is preferable that the number of island is 100 to 10,000 and an island packing density is 0.1 to 20.0 island/mm$^2$. It is more preferable that the island packing density is 1.0 to 20.0 island/mm$^2$. The island packing density means the number of islands per unit area and shows a productivity of the sea-island composite fiber comprising many islands. To calculate the island packing density, the number of islands discharged from a nozzle is divided by an area of discharge introduction hole. It is possible that the island packing density is different in each nozzle.

The composite fiber cross section formation and island component cross section shape can be controlled by a layout of distribution holes of polymer A and polymer B in the final distributor plate located just above nozzle plate 22. A desirable composite polymer flow to make a sea-island composite fiber can be formed by laying out polymer A-distribution holes 25-(*a*) and polymer B-distribution holes 25-(*b*) as shown in FIG. 7 (*a*), FIG. 7 (*b*) and FIG. 7 (*c*).

Figure 7:
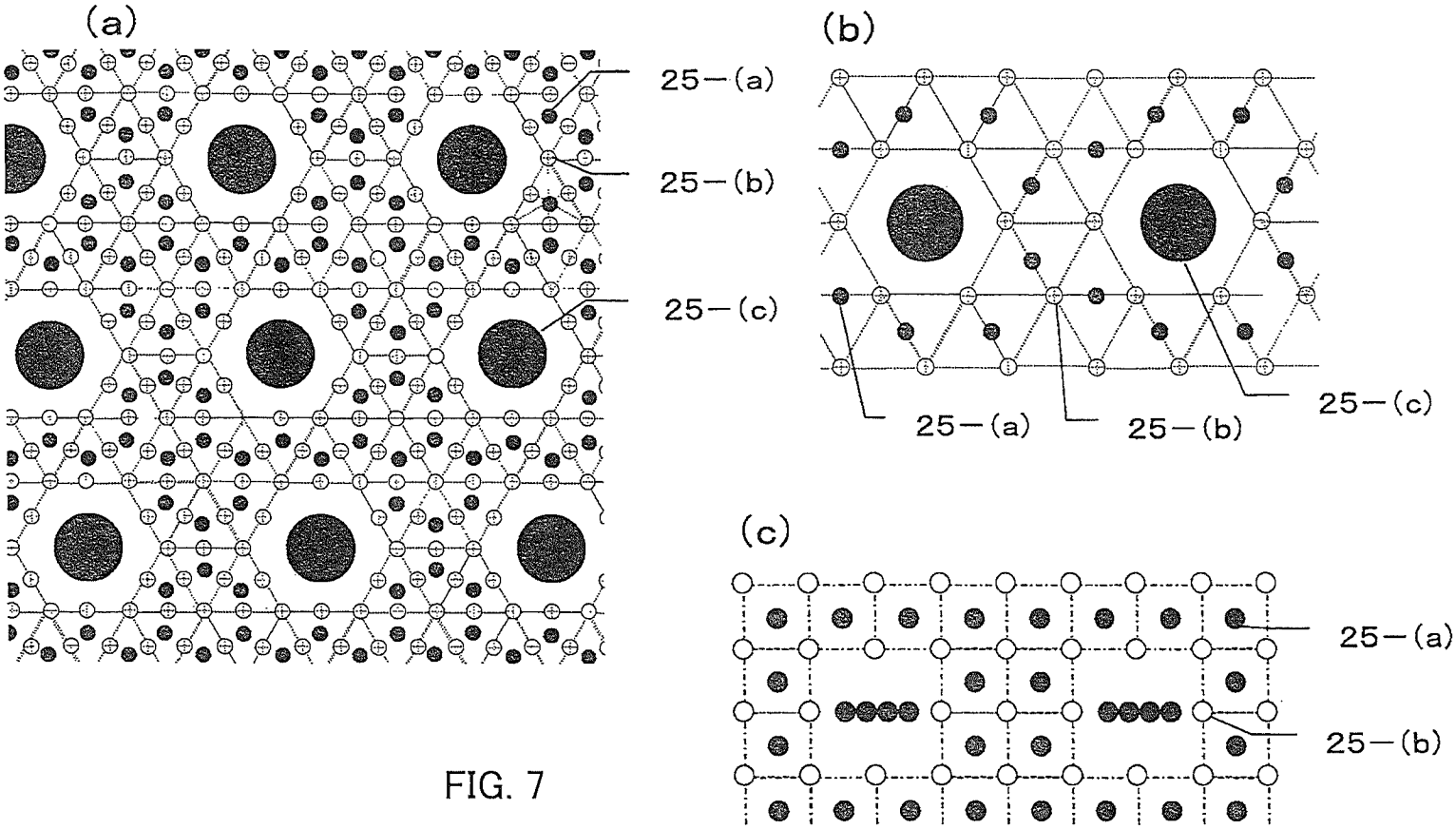
FIGS. 7 (*a*)-(*c*) are schematic plan views showing an example of layout of distribution holes in a final distributor plate, where (a) to (c) show enlarged parts of the final distributor plate.

FIG. 7 (*a*) shows regularly disposed polymer A—distribution holes 25-(*a*), polymer A—enlarged distribution holes 25-(*c*) and polymer B—distribution holes 25-(*b*). The distributor plate in the composite spinneret is configured to have thin flow paths so that a through-put rate of each distribution hole is essentially regulated by a pressure loss of distribution hole 25. Measurement plate 20 controls by a high accuracy an inflow rate of polymer A and polymer B into distributor plate 21 so that a pressure loss is uniform in thin flow paths perforating distributor plate 21. Therefore, distribution holes 25-(*c*) having partially enlarged hole diameters as shown in FIG. 7 (*a*) would automatically make the through-put rate of enlarged distribution holes 25-(*c*) greater than that of distribution holes 25-(*a*) to make a pressure loss uniform. This is a principle of forming island component controlled in a high accuracy in spite of a changed diameter. As shown in FIG. 7 (*a*), polymer B—distribution holes 25-(*b*) should be regularly laid out not to make island component adhere to each other. Such a principle is applicable to other regular layouts. The distributor plate can make any sea-island cross section freely because of a well-designed distributor plate and an accurate control of polymer inflow rate with a measurement plate. On the other hand, a single-stage measurement control with filters installed in flow paths of conventional spinnerets can't make our sea-island composite fibers. The pressure (inflow rate) can't be prevented from fluctuating with a single-stage measurement. The polymer pressure loss should be uniform in the distributor plate as described above. Such a fluctuation of pressure (inflow rate) may be further increased in a certain position in the spinneret.

FIG. 7 (*a*), FIG. 7 (*b*) and FIG. 7 (*c*) show examples of polygonal lattice layout of distribution holes. The distribution holes may be laid out along a circumference around an island component distribution hole. The layout of the holes should be determined depending on a combination of polymers. It is preferable that the layout of the distribution holes is a polygonal lattice layout, at least a square lattice layout, from a viewpoint of variety of the polymer combination. Without enlarged distribution holes provided, it is possible as shown in FIG. 7 (*c*) that a plurality of polymer A-distribution holes 25-(*a*) adjacent to each other through which polymer A component is discharged are adhered to each other by using the Barns effect to form island components having a certain irregularity and enlarged island component diameters. In this example, the distribution holes can be designed to have the same diameter so that the pressure loss is easily predicted and the spinneret is designed simply.

To achieve a cross section formation of the sea-island composite fiber, in addition to the above-described layout of distribution holes, it is preferable that a melt viscosity ratio (polymer A/polymer B) of polymer A to polymer B is 0.1 to 20.0. Although the island components are controlled to extend to a range basically depending on the layout of distribution holes, the melt viscosity ratio of polymer A to polymer B, which represents a stiffness ratio in melting, affects on a cross section formation because the island component flows join together through reduction hole 28 of nozzle plate 22 and reduce in a cross section direction. Therefore, it is more preferable that the melt viscosity ratio (polymer A/polymer B) is 0.5 to 10.0. The sea-island composite fiber has a melting point and a heat resistance which depend on a composition of polymer A and polymer B. Therefore, it is ideally preferable that the spinning process is performed at a melting temperature suitable for each polymer composition. However, a special spinning machine may be required to individually control the melting temperature for each polymer. Thus, it is usual that the spinning temperature is set to a predetermined temperature. From the viewpoint of simple setting of the spinning conditions such as temperature, it is particularly preferable that the melt viscosity ratio of polymer A to polymer B is 0.5 to 5.0. The melt viscosity can be controlled flexibly even with a certain kind of polymer by adjusting a molecular weight or copolymerization component. Therefore, the melt viscosity is employed as an index in setting the polymer combination and the spinning condition.

A composite polymer flow comprising polymer A and polymer B discharged from the distributor plate flows into discharge introduction hole 26. It is preferable that nozzle plate 22 has discharge introduction holes 26. The discharge introduction hole 26 means a hole through which a composite polymer flow discharged from distributor plate 21 flows in a direction perpendicular to a discharge surface within a predetermined distance. Such a hole reduces a difference of flow rates of polymer A and polymer B, as well as a flow rate distribution of the composite polymer flow in a cross section direction. From the viewpoint of flow rate distribution reduction, it is preferable that a flow rate of the polymer is controlled by adjusting a through-put rate, hole diameter and the number of holes of distribution holes 25. However, a spinneret designed to make such a control might restrict the number of islands or the like. Therefore, to finish the reduction of the difference of flow rates, it is preferable that discharge introduction hole 26 is designed to take time of 10-1 to 10 sec (corresponding to discharge introduction hole length/polymer flow rate) to introduce the composite polymer flow into reduction hole 27, although a polymer molecular weight should be considered. The time within such a range can sufficiently reduce the flow rate distribution to improve the stability of the cross section.

The composite polymer flow is reduced in a cross section direction along the polymer flow through reduction hole 27 as being introduced into nozzle having a desired diameter. The composite polymer flow has a streamline of which a middle layer is almost linear and which greatly bends as approaching outer layer. To prepare the sea-island composite fiber, it is preferable that the composite fiber flow is reduced while maintaining a cross section formation of the composite polymer flow comprising numberless polymer flows including polymer A and polymer B. It is preferable that reduction hole 27 has a pore wall inclined to a discharge surface by 30 to 90°.

To maintain the cross section formation of reduction hole 27, it is preferable that a layer of sea component is provided in an outermost layer of the composite polymer flow. The layer of sea component may be formed with ring-shaped groove 29 as shown in FIG. 6 (*b*) having distribution holes on the bottom face of distributor plate just above the nozzle plate. The composite polymer flow discharged from the distributor plate is greatly reduced in a cross section with a reduction hole. At this time, the outer layer of the composite polymer flow is greatly bent and is subjected to a shear stress. The detailed flow rate distribution from the pore wall to the outer layer of the polymer flow may have an inclined tendency, in which the flow rate is less because of the shear stress applied at the surface contacting the pore wall and the flow rate increases toward the inner layer side. The shear stress applied to the pore wall can be received on the outermost layer comprising sea component (polymer B) in the composite polymer flow to stabilize the composite polymer flow, particularly fluctuating island components. Thus, the sea-island composite fiber has a greatly improved uniformity of island component (polymer A) in fiber diameter and fiber shape. To provide the sea component (polymer B) in the outermost layer of the composite polymer flow, it is preferable that distribution hole 25 perforating the bottom face of ring-shaped groove 29 as shown in FIG. 6 (*d*) is designed depending on the number of distribution grooves and through-put rate of the distributor plate. It is reasonable that the distribution holes are provided by 1 hole per circumferential angle of 3°, preferably 1 hole per circumferential angle of 1°. To introduce a polymer into ring-shaped groove 29 at ease, it is possible that the distribution holes are provided at both ends of sea component polymer distribution groove 24 extending in a cross section direction in the upstream distributor plate. FIG. 6 (*d*) shows an example of distributor plate having sole ring-shaped groove 29 wherein two or more ring-shaped grooves may be provided. It is possible that each different kind of polymer is flowed in each ring-shaped groove.

Thus, the composite polymer flow, as maintaining the cross section formation having the layout of distribution holes 25, is discharged through nozzle 28 to make a spun yarn via discharge introduction hole and reduction hole 27. Nozzle 28 again measures a through-put rate of the composite polymer flow and controls a draft (=take-up speed/discharge linear speed) on the spun yarn. The hole diameter and hole length of nozzle 28 should be designed depending on the viscosity and through-put rate of the polymer. It is possible that the nozzle diameter D is 0.1 to 2.0 mm and L/D (nozzle length/nozzle diameter) is 0.1 to 5.0.

From the viewpoint of productivity and production equipment simplicity, it is preferable that the sea-island composite fiber is produced by a melt spinning method. With the above-described composite spinneret, the sea-island composite fiber can be produced even by a spinning method such as solution spinning method using a solvent.

In the melt spinning method, the island component and sea component may be a thermoplastic polymer such as polyethylene terephthalate or its copolymer, polyethylene naphthalate, polybutylene terephthalate, polytrimethylene terephthalate, polypropylene, polyolefin, polycarbonate, polyacrylate, polyamide, polylactic acid, thermoplastic polyurethane. Particularly, a polycondensation polymer such as polyester and polyamide has a desirably high melting point. The melting point of the polymer of 165° C. or more can have a good heat resistance. It is possible that the polymer contains various additives including a mineral material such as titanium oxide, silica and barium oxide, a coloring agent such as carbon black dye and pigment, a fire retardant, a fluorescent brightener, an antioxidant, an ultraviolet absorbent or the like. To perform a sea-removal or island-removal process, the polymer may be thermoplastic and more soluble than the other component such as polyester or its copolymer, polylactic acid, polyamide, polystyrene or its copolymer, polyethylene and polyvinyl alcohol. It is preferable that the polymer is a copolymerized polyester which is soluble in aqueous solvent or hot liquid, a polylactic acid, a polyvinyl alcohol or the like. From the viewpoint of spinnability and easy dissolution with low-concentration aqueous solvent, it is particularly preferable that the polymer is polyethylene glycol, polylactic acid or polyester copolymerized with single or multiple sodium sulfoisophthalic acid. From the viewpoint of sea-removal efficiency and opening of ultrathin fiber, it is particularly preferable that the polymer is a polyester copolymerized with single sodium sulfoisophthalic acid.

The above-described combination of slightly soluble component and easily soluble component can be selected. For example, the slightly soluble component is selected depending on a target use while the easily soluble component is selected from the viewpoint of spinnability at the melting point of the slightly soluble component. From the viewpoint of improved uniformity of island component of the sea-island composite fiber in fiber diameter and cross section shape, it is preferable that each component is adjusted in molecular weight depending on the above-described melt viscosity ratio. To produce a mixed yarn from the sea-island composite fiber, it is preferable that a ratio of a dissolution speed in a solvent used for the sea-removal between the slightly soluble component and the easily soluble component is greater, from the viewpoint of stable cross section shape and maintained mechanical properties of the mixed yarn. The combination of the above-described polymers can be selected based on a target dissolution speed of 3,000 or less. From the viewpoint of melting point, the polymer combination suitable to produce a mixed yarn from the sea-island composite fiber may be the sea component of polyethylene terephthalate copolymerized with 1 to 10 mol % of 5-sodium sulfoisophtaltic acid and the island component of polyethylene terephthalate or polyethylene naphthalate. Alternatively, it may be the sea component of polylactic acid and the island component of nylon 6, polytrimethylene terephthalate or polybutylene terephthalate.

The sea-island composite fiber should be spun at a temperature at which a polymer having a higher melting point or higher viscosity is fluid. The temperature depending on the fluidity should be less than or equal to the melting point plus 60° C. although even depending on molecular weights. The temperature under the upper limit could prevent the molecular weight from decreasing with no thermolysis of polymer in the spinning head or spinning pack.

To stably discharge the sea-island composite fiber, it is possible that the through-put rate is 0.1 g/min/hole to 20.0 g/min/hole per 20 nozzles. The pressure loss should be designed to keep a stable discharge. It is preferable that the pressure loss is designed in a target range of 0.1 MPa to 40 MPa as considering a relation with melt viscosity, nozzle diameter and nozzle length.

The weight ratio of slightly soluble component to easily soluble component can be 5/95 to 95/5 as a sea/island ratio based on a through-put rate in spinning the sea-island composite fiber. From the viewpoint of productivity of mixed yarn, it is preferable that the island component is in a majority between the sea and island. It is more preferable that the sea/island ratio is 10/90 to 50/50 so that the ultrathin fiber is produced efficiently and stably, from a viewpoint of long term stability of a sea-island composite cross section. It is particularly preferable that the sea/island ratio is 10/90 to 30/70, from viewpoints of rapid sea-removal process and improved opening of ultrathin fiber.

Thus, discharged sea-island composite polymer flow is cooled to solidify and an oil is added thereto to be rewound with a roller at a predetermined circumferential speed to make a sea-island composite fiber. It is preferable that the predetermined circumferential speed is 100 to 7,000 m/min to produce the sea-island composite fiber stably. The circumferential speed may be designed based on the throughput rate and target fiber diameter. From the viewpoint of high orientation for improved mechanical properties, it is possible that the sea-island composite fiber is drawn after being once rewound or without being once rewound.

For example, a fiber made of a thermoplastic polymer can be drawn at ease in a fiber axis direction at a circumferential speed ratio between the speed of the first roller set to a temperature above the glass transition temperature and below the melting point and the speed of the second roller set to a temperature around the crystallization temperature, and then is heat set and rewound to obtain the sea-island composite fiber. Alternatively, a polymer without glass transition may be preheated above a higher peak temperature of tan δ obtained by measuring a dynamic viscoelasticity (tan δ) of the sea-island composite fiber. It is even preferable that multi-staged drawing processes are performed to enhance the draw ratio to improve mechanical properties.

Thus, prepared sea-island composite fiber may be immersed in solvent capable of dissolving an easily soluble component to remove the easily soluble component to obtain an ultrathin fiber yarn comprising a slightly soluble component. The easily soluble component comprising a copolymerized PET copolymerized with 5-sodium sulfoisophthalic acid or polylactic acid (PLA) could be removed with alkali solution such as sodium hydroxide solution. The composite fiber or a fiber structure comprising the composite fiber may be immersed in the alkali solution. The alkali solution heated above 50° C. could accelerate a progression of hydrolysis. From an industrial aspect, a fluid dyeing machine is preferably used to achieve a mass production with a good productivity.

The above-described explanation has been based on a general melt spinning method to produce an ultrathin fiber. Alternatively, the ultrathin fiber may be produced by a melt-blowing method or spunbond method as well as a wet or dry-wet solution spinning method.

EXAMPLES

Hereinafter, the ultrathin fiber will be concretely explained with examples.

Examples and Comparative Examples are evaluated as follows.

A. Melt Viscosity of Polymer

Chip-shaped polymer is dried to have a water content of 200 ppm or less with a vacuum dryer and a distortion speed is changed stepwise to measure a melt viscosity with CAPILOGRAPH 1B made by Toyo Seiki Seisaku-sho, Ltd. The measurement is performed at the same temperature as the spinning temperature. The melt viscosities described in Examples and Comparative Examples are determined at 1216 $s^{-1}$. The measurement is performed under nitrogen atmosphere 5 min after a sample is injected into a heating furnace.

B. Fineness

Fineness is calculated by centuplicating a sea-island composite fiber weight per 100 m length. Ten sets of the measurement are performed and the simple average value is rounded to a whole number to obtain a fineness.

C. Mechanical Properties of Fiber

The sea-island composite fiber is subjected to a measurement of a stress-distortion profile at conditions of sample length 20 cm and tensile speed 100%/min with a tensile tester TENSILON UCT-100 made by Orientec Co., Ltd. The measured rupture load is divided by the initial fineness to calculate a tensile strength while the measured rupture distortion is divided by the sample length and then centuplicated to calculate an elongation at break. Five sets of both measurements are performed, and the simple average value of the tensile strength is rounded to one decimal place while the simple average value of the elongation at break is rounded to a whole number.

D. Island Component Diameter and Island Component Diameter Coefficient of Variation (CV %)

The sea-island composite fiber is embedded with epoxy resin and is frozen with FC-4E type cryosectioning system made by Reichert, Inc. to be subjected to a cutting process with Reichert-Nissei ultracut N (ultramicrotome) having a diamond knife. An image of the cut surface including 150 pieces of island components is taken with H-7100FA type transmission electron microscope (TEM) made by Hitachi, Ltd. Island component diameters of 150 pieces of island components randomly selected from the image are measured with an image processing software (WINROOF) to calculate an average value and a standard deviation. A fiber diameter CV % is calculated from the measurement result based on the following formula:

$$\text{Island component diameter coefficient of variation } (CV\%) = (\text{standard deviation}/\text{average value}) \times 100.$$

10 samples of the image are measured to calculate an average value among the 10 samples. An island component diameter is rounded to a whole number by nm unit while an island component diameter coefficient of variation is rounded to one decimal place.

E. Irregularity and Irregularity Coefficient of Variation (CV %) of Island Component Like the above-described circumscribed circle diameter and circumscribed circle diameter coefficient of variation, the cross section image of island component is taken to measure a diameter of a circumscribed circle (true circle shown with symbol 2 in FIG. 1) and a diameter of a inscribed circle (true circle shown with symbol 3 in FIG. 1). An irregularity as a ratio of the circumscribed circle diameter to the inscribed circle diameter is rounded to one decimal place. The irregularity is measured for 150 pieces of island components randomly selected in the same image to calculate an irregularity coefficient of variation from the average value and standard deviation based on the following formula:

$$\text{Irregularity coefficient of variation } (CV\%) = (\text{standard deviation of irregularity}/\text{average irregularity}) \times 100[\%].$$

10 samples of the image are measured to calculate an average irregularity coefficient of variation among the 10 samples. The average irregularity coefficient of variation is rounded to one decimal place.

F. Evaluation of Layout of Island Component B

The island component interval is defined as interval (shown in FIG. 5 with symbol 19) between island component B centers of as circumcenters of the circumscribed circle (shown in FIG. 1 with symbol 2). The island component interval is measured per randomly selected 100 parts in a two dimensional image of island fiber cross section like the above-described island component diameter. Unless an image includes 200 pieces of island components B, intervals measured with another image are added to make a total 100 interval results measurement results. The island component interval coefficient of variation (CV %) is a value calculated by the formula of (standard deviation of island component interval)/(average island component interval)×100 [%] and then rounded to one decimal place.

G. Evaluation of Falling of Ultrathin Fiber (Island Component) in Sea-Removal Process From a knitted fabric comprising sea-island composite fiber prepared in each spinning condition, sea component of 99% or more is removed in a sea-removal bath (bath ratio 100) filled with solvent to dissolve the sea component. To confirm if the ultrathin fiber has fallen off or not, an evaluation is performed as follows.

100 ml of the solvent after the sea-removal process is filtered with a fiberglass filter having of retained particle diameter 0.5 μm. The falling off of ultrathin fiber is evaluated into 4 grades from dry weight difference before and after the filtration:

S (No falling): weight difference less than 3 mg

A (Slight falling): weight difference of 3 mg to less than 7 mg

B (Falling): weight difference of 7 mg to less than 10 mg

F (Much falling): weight difference of 10 mg or more.

H. Evaluation of Coloring

From a cylindrical knitted fabric comprising the obtained fiber, sea component of 99% or more is removed with solvent (by bath ratio of 1:100) capable of dissolving the sea component so that a cylindrical knitted fabric comprising a mixed yarn is prepared. The fabric is dyed for 60 min by bath ratio of 1:30 in the solution comprising: 10% disperse dye of SUMIKARON Black S-BB10 made by Sumitomo Chemical Co., Ltd.; 0.5 cc/l acetic acid; and 0.2 g/l sodium acetate. It is subjected to a usual reduction cleaning for 20 min at 80° C. in the solution comprising: 2 g/l hydrosulfite; 2 g/l of sodium hydroxide; and 2 g/l nonionic surfactant (SANDET G-900), and then washed with water and dried up. Thus, obtained dyed cylindrical knitted fabric (15% weight loss product) is subjected to a measurement with a spectrum colorimeter (MINOLTA CM-3700D) in a condition of 8 mmϕ measurement diameter, light source of D65 and 10° of view angle. The results of three sets of the measurement are averaged into $L_{ave}$* to be evaluated into three grades:

A (Good): less than 14

B (Acceptable): 14 to less than 16

F (Not acceptable): more than 16.

I. Evaluation of Water Absorption

A water absorption of the obtained fiber is measured according to JIS L1096 (1999) by "Byreck method." A water absorption height measured by the method is evaluated into the four grades as follows:

S (Excellent): 90 mm or more

A (Good): 65 mm to less than 90 mm

B (Acceptable): 55 mm to less than 65

F (Not acceptable): less than 55 mm.

Example 1

Polyethylene terephthalate (PET1; melt viscosity: 160 Pa·s) as an island component and PET copolymerized with 8.0 mol % of 5-sodium sulfoisophthalic acid (copolymerized PET1; melt viscosity: 95 Pa·s) as a sea component were separately melt and measured, and then they were flowed into a spinning pack embedding the composite spinneret shown in FIG. 6 to discharge a composite polymer flow through nozzles. The distributor plate just above the nozzle plate had island component distribution holes of total 790 holes per one nozzle, wherein 720 holes of distribution holes 25-(*a*) (hole diameter: ϕ0.20 mm) and 70 holes of distribution holes 25-(*c*) (hole diameter: ϕ0.65 mm) were laid out in the pattern shown in FIG. 7 (*a*). A ring-shaped groove for sea component as shown in FIG. 6 (*d*) with symbol 29 had distribution holes at every 1° along the circumferential direction.

It had 5 mm of discharge introduction hole length, 60° of reduction hole angle, 0.5 mm of nozzle diameter and 1.5 of a ratio of nozzle length/nozzle diameter. A composition ratio of sea/island components was 20/80. Thus, discharged composite polymer flow was cooled to solidify and then oil was added, and the as-spun fiber having 200 dtex-15 filament (total through-put rate 30 g/min) was rewound at spinning speed of 1500 m/min. Thus, rewound as-spun fiber was drawn at draw ratio of 4.0 and draw speed of 800 m/min between rollers heated to 90° C. and 130° C. respectively.

Thus, obtained sea-island composite fiber had 50 dtex-15 filament. The sea-island composite fiber had a layout in which island components having greater diameters and another kind of island components having smaller diameters and triangular cross sections were disposed regularly. Therefore, the spinnability was good without local stress concentration in the fiber cross section. The drawability was found excellent such that the fiber had been drawn with 10 weights of a tenter for 4.5 hours without yarn breakage.

The sea-island composite fiber had mechanical properties such as tensile strength of 4.0 cN/dtex and elongation at break of 30%.

The triangular cross section of the sea-island composite fiber had an island component (island component A) having irregularity of 2.0, irregularity coefficient of variation of 3.0%, island component diameter of 520 nm and island component diameter coefficient of variation of 5.3%. Another kind of island component (island component B) having the greater diameter had irregularity of 1.0, irregularity coefficient of variation of 2.7%, island component diameter of 3,000 nm and island component diameter coefficient of variation of 4.2%.

Figure 8:
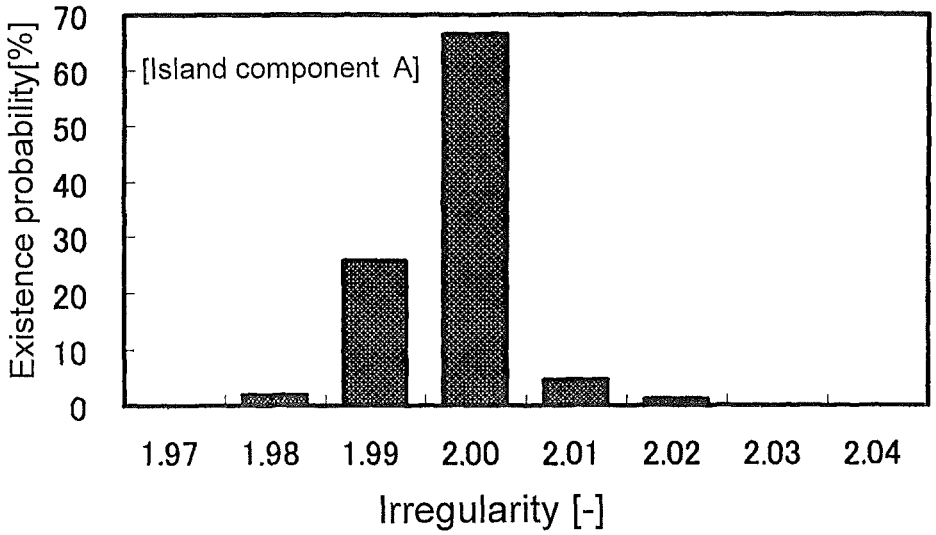
FIG. 8 is a characteristic chart showing an irregularity distribution of island components in a sea-island composite fiber cross section.
Figure 8:
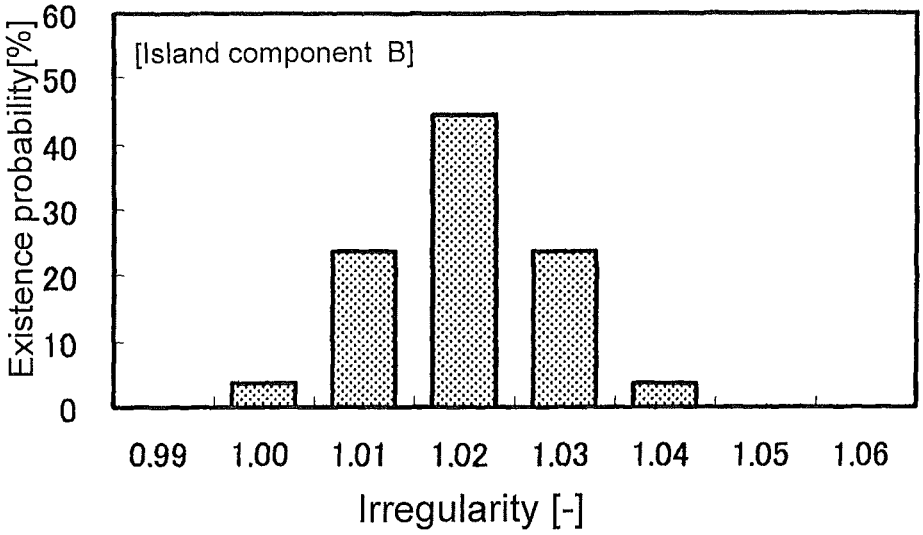
Figure 9:
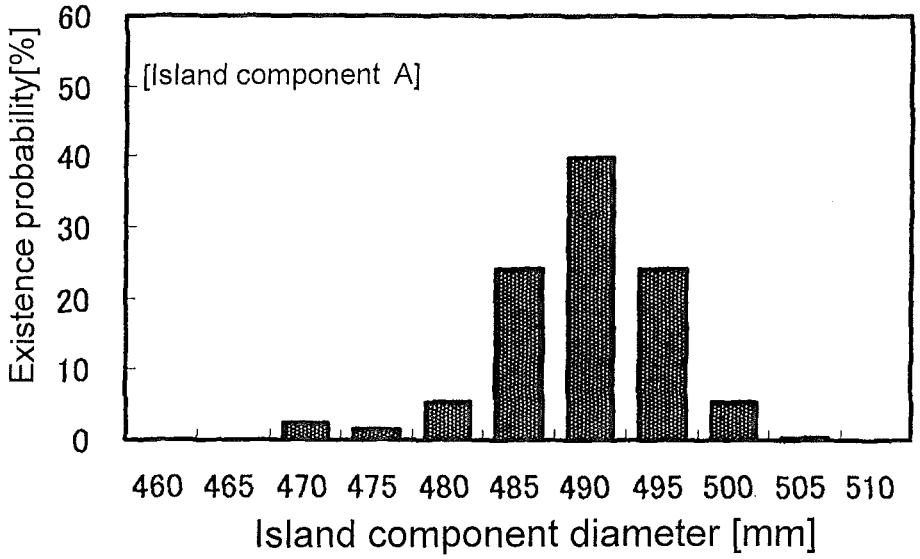
FIG. 9 is a characteristic chart showing an island component diameter distribution of island components in a sea-island composite fiber cross section.
Figure 9:
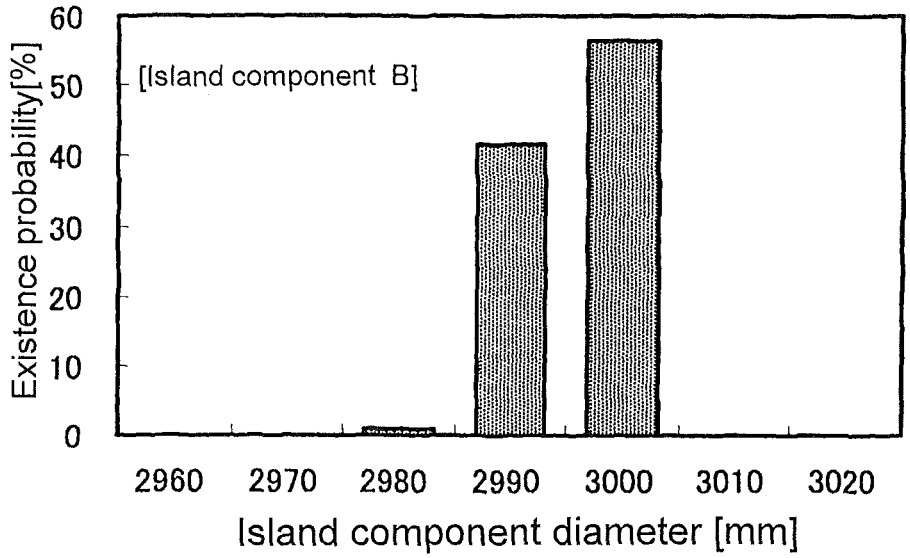

FIG. 8 and FIG. 9 show distributions of island component A and island component B in irregularity and island component diameter, in which island component A and island component B have very narrow distribution width of island component diameter and irregularity. The island component interval of island component A and island component B was calculated as 2.1% in average to find that island components A were disposed regularly around island components B without a variation.

99% of sea component was removed with 1 wt % sodium hydroxide solution at 90° C. from the sea-island composite fiber prepared in Example 1. As described above, the sea-island composite fiber had uniformly laid-out island components comprising groups of different island component diameters and irregularities. Therefore, undissolved residual substances left between fibers were removed efficiently even with a low-concentrated alkali solution. Thus, the island component was prevented from deteriorating without too much extension of treatment time and ultrathin fibers didn't fall off in the sea-removal process. (Evaluation result of falling: S) Like the evaluation of layout of island component B, the fiber (island component B) having greater diameter was evaluated with the cross section image of the mixed yarn in fiber interval coefficient of variation. As a result, the fiber interval coefficient of variation was 5% in average to find that the fibers (island component A) having smaller fiber diameters were disposed uniformly around the fibers (island component B) having greater fiber diameters, without a substantive variation of the fiber interval as well as a partially biased number of fibers existing.

The mixed yarn had fineness of 40 dtex and mechanical properties such as tensile strength of 3.6 cN/dtex and elongation at break of 40%. The fiber (island component A) had irregularity of 2.0, irregularity coefficient of variation of 3%, fiber diameter of 510 nm and fiber diameter coefficient of variation of 5%. The other fiber (island component B) having greater fiber diameters had irregularity of 1.0, irregularity coefficient of variation of 3%, fiber diameter of 3,000 nm and fiber diameter coefficient of variation of 4%.

The cylindrical knitted fabric comprising the mixed yarn had good tension and drape while the surface of the knitted fabric was particularly smooth with the small contact area derived from the nanofiber edge effect of the triangular cross section. Further, it had excellent water absorption derived from capillary phenomenon effect in the unique clearances generated between ultrathin fibers because there was an irregularity difference between ultrathin fibers comprising island component A and island component B. (Evaluation of water absorption: S) The mixed yarn had excellent coloring property with suppressed white blur, which has been found with general nanofiber fabrics, because the clearances generated between fibers by mixing fiber having different irregularities suppressed the light diffusion on the nanofiber. (Evaluation of coloring: A)

Wiping performance was evaluated by rubbing with the knitted fabric the oil spot (spot diameter: approximately 6 mm) which contained liquid paraffin (80 wt %) and carbon black (20 wt %). The oil spot was rubbed with 20 g/cm$^2$ of pressing pressure at 10 mm/min of motion speed, confirming a good wiping performance such that 80% or more (stain removal rate) of initial stain had been removed without leaving almost any oil trace on the glass plate. The stain removal rate was calculated by the formula of "Stain removal rate=(1−[stained area after wiping]/[initial stain])×100 [%]." Table 1 shows the result.

TABLE 1

| | | | Example 1 | Example 2 | Example 3 | Example 4 |
|---|---|---|---|---|---|---|
| Polymer | Sea | — | Copolymerized PET1 | Copolymerized PET1 | Copolymerized PET1 | Copolymerized PET1 |
| | Island | — | PET1 | PET1 | PET1 | PET1 |
| Sea/ Island ratio | Sea | % | 20 | 30 | 50 | 70 |
| | Island | % | 80 | 70 | 50 | 30 |
| Spinneret | Island component A | Island/ nozzle | 720 | 720 | 720 | 720 |
| | Island component B | Island/ nozzle | 70 | 70 | 70 | 70 |
| | Number of nozzles | — | 15 | 15 | 15 | 15 |
| Sea-island composite fiber | Fineness | dtex | 50 | 50 | 50 | 50 |
| | Tensile strength | cN/dtex | 4.0 | 3.5 | 2.5 | 2.3 |
| | Elongation at break | % | 30 | 30 | 29 | 29 |
| Section Parameter | Island component A, irregularity | — | 2.0 | 2.0 | 2.0 | 2.0 |
| | Island component A, irregularity coefficient of variation | % | 3.0 | 3.0 | 3.0 | 3.0 |
| | Island component A, diameter | nm | 520 | 488 | 413 | 310 |
| | Island component A, diameter coefficient of variation | % | 5.3 | 5.5 | 5.6 | 6.4 |
| | Island component B, irregularity | — | 1.0 | 1.0 | 1.0 | 1.0 |
| | Island component B, irregularity coefficient of variation | % | 2.7 | 2.6 | 2.6 | 2.5 |
| | Island component B, diameter | nm | 3000 | 2800 | 2380 | 1800 |

TABLE 1-continued

| | | | Example 1 | Example 2 | Example 3 | Example 4 |
|---|---|---|---|---|---|---|
| | Island component B, diameter coefficient of variation | % | 4.2 | 4.2 | 4.1 | 4.0 |
| | Irregularity difference | — | 1.0 | 1.0 | 1.0 | 1.0 |
| | Island component diameter difference | nm | 2480 | 2312 | 1967 | 1490 |
| | Island component interval coefficient of variation | % | 2.1 | 2.5 | 3.0 | 4.3 |
| Post-formability | ultrathin fiber falling | — | S (No falling) | S (No falling) | S (No falling) | A (Slight falling) |
| Mixed yarn Evaluation | Coloring evaluation | — | A (Good) | A (Good) | A (Good) | A (Good) |
| | Water absorption | — | S (Excellent) | S (Excellent) | S (Excellent) | S (Excellent) |
| Remarks | | | | | | |

Examples 2-4

The same operations described in Example 1 were performed except that the sea/island component composition ratio was 30/70 in Example 2, 50/50 in Example 3 and 70/30 in Example 4. Table 1 shows the evaluation results of these sea-island composite fiber, which are excellent in spinnability and post-formability like Example 1, together with the cross section of the mixed yarn having no partial unevenness in the number of component A or component B. The evaluation results were excellent in water absorption and coloring like Example 1. In Example 4, ultrathin fibers slightly fell off at an acceptable level. (Evaluation of falling: A) The stain removal rates were 80% or more by the same evaluation method as Example 1 to find that the mixed yarns had good wiping performances. The results are shown in Table 1.

Example 5

The same operations described in Example 1 were performed except that the as-spun fiber made by spinning at total through-put rate of 12.5 g/min and sea/island composition ratio of 80/20 with the distributor plate used in Example 1 was drawn at draw ratio of 3.5. In Example 5 performed at a decreased total through-put rate, the spinnability was evaluated as the same level as Example 1. This result can be regarded as an effect of uniform and regular layout of the island components.

Although the cross section of the sea-island composite fiber prepared in Example 5 had 180 nm of extremely reduced diameter, the island components had triangular cross sections (irregularity 2.0) with 3.0% of small irregularity coefficient of variation. Island components A had diameters greatly reduced than that of Example 1 so that a few nanofibers which might have been dissolved in the sea-removal process had fallen off at an acceptable level. The results are shown in Table 2.

TABLE 2

| | | | Example 5 | Example 6 |
|---|---|---|---|---|
| Polymer | Sea | — | Copolymerized PET1 | Copolymerized PET1 |
| | Island | — | PET1 | PET1 |
| Sea/Island ratio | Sea | % | 80 | 20 |
| | Island | % | 20 | 80 |
| Spinneret | Island component A | Island/nozzle | 720 | 720 |
| | Island component B | Island/nozzle | 70 | 70 |
| | Number of nozzles | — | 15 | 15 |
| Sea-island composite fiber | Fineness | dtex | 24 | 78 |
| | Tensile strength | cN/dtex | 1.8 | 3.3 |
| | Elongation at break | % | 23 | 36 |
| Section parameter | Island component A, irregularity | — | 2.0 | 2.0 |
| | Island component A, irregularity coefficient of variation | % | 3.0 | 2.7 |
| | Island component A, diameter | nm | 180 | 650 |
| | Island component A, diameter coefficient of variation | % | 7.0 | 5.9 |

TABLE 2-continued

| | | | Example 5 | Example 6 |
|---|---|---|---|---|
| | Island component B, irregularity | — | 1.0 | 1.0 |
| | Island component B, irregularity coefficient of variation | % | 3.0 | 3.0 |
| | Island component B, diameter | nm | 1040 | 3800 |
| | Island component B, diameter coefficient of variation | % | 4.5 | 4.5 |
| | Irregularity difference | — | 1.0 | 1.0 |
| | Island component diameter difference | nm | 860 | 3150 |
| | Island component interval coefficient of variation | % | 7.3 | 4.0 |
| Post-formability | ultrathin fiber falling | — | A (Slight falling) | S (No falling) |
| Mixed yarn evaluation | Coloring evaluation | — | B (Acceptable) | A (Good) |
| | Water absorption | — | S (Excellent) | A (Good) |
| | Remarks | | | Good coloring |

Example 6

The same operations described in Example 1 were performed except that the as-spun fiber made by spinning at total through-put rate of 35.0 g/min and sea/island composition ratio of 20/80 with the distributor plate used in Example 1 was drawn at draw ratio of 3.0.

As a result, we found in the cross section of the mixed yarn after the sea-removal process that island components A having triangular cross sections (irregularity 2.0) existed uniformly around island components B having circular cross section (irregularity 1.0). The mixed yarn made from the sea-island composite fiber in Example 6 had the excellent coloring property enough to produce the fabric having a deep color with less whiteness relative to Example 1. The results are shown in Table 2.

Example 7

The same operations described in Example 1 were performed, except that the island component was polyethylene terephthalate (PET2; melt viscosity: 90 Pa·s) having the less viscosity relative to PET1 in Example, the sea component was PET copolymerized with 5-sodium sulfoisophthalic acid (copolymerized PET2; melt viscosity: 140 Pa·s) and the draw ratio was 3.0.

In the sea-island composite fiber obtained in Example 7, island components A having island component diameter of 570 nm and triangular cross sections (irregularity 2.1) were disposed regularly around island components B having island component diameter of 3,300 nm and hexagonal cross sections (irregularity 1.3). The mixed yarn made from the sea-island composite fiber obtained in Example 7 had greater tension and drape as being excellent in coloring property relative to Example 1. The results are shown in Table 3.

TABLE 3

| | | | Example 7 | Example 8 | Example 9 | Example 10 |
|---|---|---|---|---|---|---|
| Polymer | Sea | — | Copolymerized PET2 | Copolymerized PET2 | Copolymerized PET2 | Copolymerized PET2 |
| | Island | — | PET2 | PET2 | PET2 | PET2 |
| Sea/ Island ratio | Sea | % | 20 | 80 | 20 | 20 |
| | Island | % | 80 | 20 | 80 | 80 |
| Spinneret | Island component A | Island/ nozzle | 720 | 1500 | 1000 | 1000 |
| | Island component B | Island/ nozzle | 70 | 50 | (4 holes in proximity) | (500 holes in proximity) |
| | Number of nozzles | — | 15 | 15 | 15 | 15 |
| Sea-island composite fiber | Fineness | dtex | 67 | 50 | 50 | 50 |
| | Tensile strength | cN/dtex | 2.3 | 3.7 | 3.4 | 4.2 |
| | Elongation at break | % | 30 | 30 | 30 | 34 |
| Section parameter | Island component A, irregularity | — | 2.1 | 1.4 | 1.4 | 1.4 |
| | Island component A, irregularity coefficient of variation | % | 2.8 | 3.1 | 3.0 | 4.0 |

TABLE 3-continued

| | | | Example 7 | Example 8 | Example 9 | Example 10 |
|---|---|---|---|---|---|---|
| | Island component A, diameter | nm | 570 | 530 | 530 | 445 |
| | Island component A, diameter coefficient of variation | % | 5.0 | 6.5 | 5.6 | 5.3 |
| | Island component B, irregularity | — | 1.3 | 1.2 | 3.8 | 1.0 |
| | Island component B, irregularity coefficient of variation | % | 3.0 | 3.0 | 3.0 | 4.0 |
| | Island component B, diameter | nm | 3300 | 3300 | 1900 | 4470 |
| | Island component B, diameter coefficient of variation | % | 4.5 | 4.3 | 7.8 | 3.0 |
| | Irregularity difference | — | 0.8 | 0.2 | 2.4 | 1.0 |
| | Island component diameter difference | nm | 2730 | 2770 | 1370 | 4025 |
| | Island component interval coefficient of variation | % | 2.8 | 3.5 | 8.1 | — |
| Post-formability | ultrathin fiber falling | — | A (Slight falling) | S (No falling) | S (No falling) | S (No falling) |
| Mixed yarn Evaluation | Coloring evaluation | — | A (Good) | A (Good) | A (Good) | A (Good) |
| | Water absorption | — | S (Excellent) | A (Good) | A (Good) | A (Good) |
| Remarks | | | | Excellent texture | Core/sheath-structured Island A and island B; Excellent Water absorption | |

Example 8

The same operations described in Example 7 were performed with polymers of copolymerized PET2 and PET2, except that the distributor plate had holes laid out as shown in FIG. 7 (*b*).

In the sea-island composite fiber obtained in Example 8, island components A having island component diameter of 530 nm and quadrangular cross sections (irregularity 1.4) were disposed regularly around island components B having island component diameter of 3,300 nm and hexagonal cross sections (irregularity 1.2). The results are shown in Table 3.

Example 9

The same operations described in Example 7 were performed with polymers of copolymerized PET2 and PET2, except that the distributor plate had holes laid out as shown in FIG. 7 (*c*). The distributor plate in Example 9 didn't have any enlarged distribution hole 17(*c*) while four island component B distribution holes 17(*a*) were disposed laterally therein.

In the sea-island composite fiber obtained in Example 9, island components A having island component diameter of 530 nm and quadrangular cross sections (irregularity 1.4) were disposed regularly around island components B having island component diameter of 1,900 nm and flat cross sections (irregularity 3.8). The mixed yarn had nanofibers having quadrangular cross sections around flat yarn on the order of micron size. In addition to its dry texture derived from low friction on the knitted surface with edge effect, the mixed yarn was extremely flexible with flat core yarns and had a comfortably excellent texture that had never been achieved by fabrics made from conventional microfibers or nanofibers. The results are shown in Table 3.

Example 10

The same operations described in Example 7 were performed, except that the distributor plate had 1,000 holes of island component holes (hole diameter: ϕ0.2 mm) per a nozzle, which were laid out such that 500 holes of the island component holes were perforated adjacent to the center of the group while the other 500 holes were disposed regularly around them according to the same design concept as Example 9.

In the sea-island composite fiber obtained in Example 10, island components A having island component diameter of 495 nm and quadrangular cross sections (irregularity 1.4) were disposed regularly around island components B having island component diameter of 4,470 nm and circular cross sections (irregularity 1.1). Island component B after the sea-removal process had numberless unevenness which seemed to have been formed in discharging. The mixed yarn had a configuration in which numberless island components A were fixed on surfaces of island components B as being contributed to by regular layout in the sea-island composite fiber phase. By a synergy of microscopic recesses and simulated porous structure formed with clearances between island components A provided at the sheath, the fabric had an excellent coloring property enough to produce the fabric having the deep color as well as excellent water absorption by the capillary phenomenon. The results are shown in Table 3.

Comparative Example 1

The processes such as spinning process described in Example 1 were performed with the conventional pipe-shaped sea-island composite spinneret (the number of islands per one nozzle: 500) disclosed in JP2001-192924-A. Although the spinning process was successfully finished without yarn breakage, yarn breakage derived from ununiform cross section was found for two weights in 4.5 hours of sampling of the stretch process. It was found that the island components of which ratio was increased to 80% had adhered to each other on the cross section of the sea-island composite fiber after being spun. By observing the composite cross section of the fiber, there were island components A (irregularity: 1.1; irregularity coefficient of variation: 13.0%) having distorted-circular cross sections and island components B (irregularity: 3.4; irregularity coefficient of variation: 17.0%) generated from the island components A adhering to each other.

Since the sea-island composite fiber was subjected to the sea-removal process to find the ultrathin fibers fallen and the knitted fabric broken, the sea-removal from the single sea-island composite fiber was given up. Instead, the as-spun fiber made by spinning PET1 used for the island component with a general spinneret of ϕ0.3 (L/D=1.5)-12 hole was drawn at draw ratio of 2.5 in the same stretch condition as Example 1 so that a single yarn comprising PET1 of 40 dtex-12 filament was produced as a core yarn. The sea-island composite fiber and the single yarn were supplied to a winding machine provided with a roller to be subjected to a post-mixing process. Even the low-speed rewinding at 200 m/min often made single yarns wind around the feed roller or around the guide roller of the winding machine. (post-mixed yarn properties: fineness 90 dtex, tensile strength 2.2 cN/dtex, elongation at break 24%).

A cylindrical knitted fabric made from the post-mixed yarn was subjected to the sea-removal process to find that the ultrathin fiber had a poor compatibility with the core yarn. Although it was better than a case of single sea-island composite fiber, the falling off derived from the island component diameter coefficient of variation of the sea-island composite fiber had often been observed. (Evaluation of falling: F). Because of partially biased ultrathin fibers and core yarns, the coloring property was bad with color shading. (Evaluation of coloring: F). In the wiping performance evaluation as performed in Example 1, the stain removal rate was poorer than that of the mixed yarn while ultrathin fibers which seemed to be broken by abrasion with stain and glass plate fell off. The results are shown in Table 4.

TABLE 4

| | | | Comparative Example 1 | Comparative Example 2 |
|---|---|---|---|---|
| Polymer | Sea | — | Copolymerized PET1 | Copolymerized PET1 |
| | Island | — | PET1 | PET1 |
| Sea/Island ratio | Sea | % | 50 | 50 |
| | Island | % | 50 | 50 |
| Spinneret | Island component | Island/nozzle | 500 | 300 |
| | Number of nozzles | — | 15 | 15 |
| Sea-island composite fiber | Fineness | dtex | 50 | 50 |
| | Tensile strength | cN/dtex | 2.4 | 2 |
| | Elongation at break | % | 21 | 24 |
| Section parameter | Island component A, irregularity | — | 1.1 | 1.1 |
| | Island component A, irregularity coefficient of variation | % | 13.0 | 24.0 |
| | Island component A, diameter | — | 530 | 1185 |
| | Island component A, diameter coefficient of variation | % | 15.0 | 31.0 |
| | Island component B, irregularity | — | 3.4 | — |
| | Island component B, irregularity coefficient of variation | % | 17.0 | — |
| | Island component B, diameter | nm | 2450 | — |
| | Island component B, diameter coefficient of variation | % | 21.0 | — |

TABLE 4-continued

| | | | Comparative Example 1 | Comparative Example 2 |
|---|---|---|---|---|
| | Irregularity difference | — | 2.3 | — |
| | Island component diameter difference | nm | 1920 | — |
| | Island component interval coefficient of variation | % | 18.0 | Imponderable |
| Post-formability | ultrathin fiber falling | — | F (Much falling) | F (Much falling) |
| Mixed yarn evaluation | Coloring evaluation | — | F (Not acceptable) | B (Acceptable) |
| | Water absorption | — | B (Acceptable) | B (Acceptable) |
| | Remarks | | Uneven coloring | Wide distribution of island component many streaks found |

Comparative Example 2

The same operations described in Example 1 were performed, except that the sea-island spinneret (1 piece of island component plate: 300 islands, 1 piece of sea-component plate) disclosed in JP-H8-158144 was provided with a detention part and back pressure applying part for each component to make the sea/island component have a composite rate of 50/50.

The composite cross section of the yarn obtained in Comparative Example 2 had random size of island components being adhered to each other to form greater island components.

The evaluation results of the sea-island composite fiber obtained in Comparative Example 2 are shown in Table 4, in which the distributions of irregularity and island component diameter show a plurality of peak values and very broader distribution widths in the continuous distribution profile. There were some obtained island components having a size less than 1,000 nm. Because of such a low uniformity of the island component in the sea-island cross section, the spinnability was found to be low with the single yarn breakage once in the spinning process and with yarn breakage for 4 weights in the stretch process.

A cylindrical knitted fabric made from the sea-island composite fiber was subjected to the sea-removal process to find that the island component diameter coefficient of variation was too high to fix the sea-removal condition so that many island components deteriorated to fell off. (Evaluation of falling: F). The surface of the fabric including partially broken fibers exhibited a hooking touch. The coloring property was evaluated as A (good) because of greater random diameters. However, many streaks appeared on the fabric surface. In the wiping performance evaluation as performed in Example 1, many ultrathin fibers which seemed to be broken by abrasion with stain and glass plate fell off from the fiber obtained in Comparative Example 2. The results are shown in Table 4.

Example 11

The same operations described in Example 1 were performed except that the spinning speed was 3,000 m/min and the draw ratio was 3.0.

We found that the regular layout of the island components in the fiber cross section of the sea-island composite fiber could achieve a high spinnability without yarn breakage like Example 1 even under the total draft condition (spinning plus drawing) of 1.5 times as high as that of Example 1. Such a high spinnability was found to be one of our advantages, for yarn breakages were found in Comparative Examples 1 and 2 performed under a total draft condition similar to Example 1. The results are shown in Table 5, in which mechanical properties at the same level as Example 1 could be achieved in Example 11 despite a relatively severe spinning condition for a composite spinning. Further, the mixed yarn comprising a polymer N6 had a cross section configuration, uniformity and post-formability at the same level as Example 1. The results are shown in Table 5.

TABLE 5

| | | | Example 11 | Example 12 |
|---|---|---|---|---|
| Polymer | Sea | — | Copolymerized PET1 | Copolymerized PET1 |
| | Island | — | PET1 | PET1 |
| Sea/Island ratio | Sea | % | 20 | 20 |
| | Island | % | 80 | 80 |
| Spinneret | Island component A | Island/nozzle | 720 | 100 |
| | Island component B | Island/nozzle | 70 | 10 |
| | Number of nozzles | — | 15 | 100 |
| Sea-island composite fiber | Fineness | dtex | 34 | 50 |
| | Tensile strength | cN/dtex | 4.0 | 3.4 |
| | Elongation at break | % | 22 | 34 |
| Section parameter | Island component A, Irregularity | — | 2.0 | 2.0 |
| | Island component A, irregularity coefficient of variation | % | 3.5 | 4.0 |
| | Island component A, Diameter | nm | 430 | 550 |

TABLE 5-continued

| | | | Example 11 | Example 12 |
|---|---|---|---|---|
| | Island component A, diameter coefficient of variation | % | 5.0 | 5.0 |
| | Island component B, Irregularity | — | 1.0 | 1.0 |
| | Island component B, irregularity coefficient of variation | % | 3.0 | 3.0 |
| | Island component B, Diameter | nm | 2400 | 1030 |
| | Island component B, diameter coefficient of variation | % | 4 | 3.9 |
| | Irregularity difference | — | 1.0 | 1.0 |
| | Island component diameter difference | nm | 1970 | 480 |
| | Island component interval coefficient of variation | % | 2.3 | 5.0 |
| Post-formability | ultrathin fiber falling | — | A (Slight falling) | S (No falling) |
| | Remarks | | | |

Example 12

The same operations described in Example 7 were performed, except that the distributor plate of which the number of groups per spinneret was changed to 100 had 100 island component A holes (hole diameter: ϕ0.2 mm) and 10 island component B holes (hole diameter: ϕ0.65 mm) per one nozzle while the nozzle plate had 100 nozzles having ϕ0.3 mm (L/D=1.5).

We found that the spinning process was performed with the spinnability at the same level as Example 1 without yarn breakage in the spinning process and stretch process. It is generally known that the spinnability tends to deteriorate with increased number of filaments under a constant through-put rate because the monofilament fineness of the sea-island composite fiber may decrease. However, because of the advantage of the regular layout of island component A and island component B, the spinnability was stable even under a thinner fineness less than ⅙ relative to Example 1. Further, the mixed yarn comprising a polymer PBT had a cross section configuration, uniformity and post-formability at the same level as Example 1. The results are shown in Table 5.

Example 13

The same operations described in Example 1 were performed with the island component made of nylon 6 (N6; melt viscosity: 190 Pa·s) and the sea component made of polylactic acid (PLA; melt viscosity: 95 Pa·s), except that the spinning temperature was 260° C. and draw ratio was 2.5.

Thus, obtained sea-island composite fiber had a good spinnability even if the sea component was made of PLA, because of the regularly laid out N6 (island component) receiving the stress. Further, the mixed yarn comprising the sea component made of PLA had a cross section configuration, uniformity and post-formability at the same level as Example 1. The results are shown in Table 6.

TABLE 6

| | | | Example 13 | Example 14 | Example 15 |
|---|---|---|---|---|---|
| Polymer | Sea | — | PLA | PLA | PET3 |
| | Island | — | N6 | PBT | PPS |
| Sea/Island ratio | Sea | % | 20 | 20 | 20 |
| | Island | % | 80 | 80 | 80 |
| Spinneret | Island component A | Island/nozzle | 720 | 720 | 720 |
| | Island component B | Island/nozzle | 70 | 70 | 70 |
| | Number of nozzles | — | 15 | 15 | 15 |
| Sea-island composite fiber | Fineness | dtex | 80 | 63 | 67 |
| | Tensile strength | cN/dtex | 2.5 | 2.1 | 4.4 |
| | Elongation at break | % | 30 | 33 | 25 |
| Section parameter | Island component A, irregularity | — | 1.8 | 2.0 | 1.8 |
| | Island component A, irregularity coefficient of variation | % | 3.0 | 3.0 | 3.0 |
| | Island component A, diameter | nm | 690 | 600 | 640 |
| | Island component A, diameter coefficient of variation | % | 5.9 | 6.1 | 7 |
| | Island component B, irregularity | — | 1.0 | 1.0 | 1.0 |

TABLE 6-continued

| | | | Example 13 | Example 14 | Example 15 |
|---|---|---|---|---|---|
| | Island component B, irregularity coefficient of variation | % | 3.0 | 3.0 | 3.0 |
| | Island component B, diameter | nm | 1300 | 1150 | 1250 |
| | Island component B, diameter coefficient of variation | % | 4.0 | 4.5 | 4.8 |
| | Irregularity difference | — | 0.8 | 1.0 | 1.0 |
| | Island component diameter difference | nm | 610 | 550 | 610 |
| | Island component interval coefficient of variation | % | 4.0 | 5.5 | 5.6 |
| Post-formability | ultrathin fiber falling | — | S (No falling) | S (No falling) | S (No falling) |
| | Remarks | | | | |

Example 14

The spinning process was performed with the island component made of polybutylene terephthalate (PBT; melt viscosity: 120 Pa·s) and the sea component made of PLA (melt viscosity: 110 Pa·s) at spinning temperature of 255° C. and the spinning speed of 1,300 m/min. The drawing process was performed at draw ratio of 3.2. The other conditions accorded to Example 1.

The spinning process and the drawing process were performed successfully. Further, the mixed yarn comprising the island component made of PBT had a cross section configuration, uniformity and post-formability at the same level as Example 1. The results are shown in Table 6.

Example 15

The spinning process was performed at spinning temperature of 310° C. with the island component made of polyphenylene sulfide (PPS; melt viscosity: 180 Pa·s) and the sea component made of high-molecular weight polyethylene terephthalate (PET3; melt viscosity: 240 Pa·s) which had been prepared by polymerizing the PET described in Example 1 in solid phase at 220° C. The two-staged drawing process was performed with the as-spun fiber at draw ratio of 3.0 between rollers heated to 90° C., 130° C. and 230° C. The other conditions accorded to Example 1.

The spinning process and the drawing process were performed successfully. Further, the mixed yarn comprising the island component made of PPS had a cross section configuration, uniformity and post-formability at the same level as Example 1. The sea-island composite fiber prepared in Example 15, which can be applied to filters having a high chemical resistance as is, was subjected to the sea-removal process with 5 wt % sodium hydroxide solution by 99% or more removal rate to confirm a possibility of applying to filters having a high performance (high dust collecting performance). Thus, obtained mixed yarn having a high alkali resistance derived from PPS constituting the island component had a structure suitable to a high performance filter in which PPS nanofibers surround PPS fibers having a greater fiber diameter as a support medium. The results are shown in Table 6.

INDUSTRIAL APPLICATIONS

The sea-island composite fiber is applicable to producing a high-performance fabric with excellent quality stability and post-formability.

The invention claimed is:

1. A sea-island composite fiber comprising two or more kinds of island components having different cross section shapes of which an irregularity difference is 0.2 or more in a same fiber cross section, wherein 1) first island components (A) having an irregularity of 1.2 to 5.0, an irregularity coefficient of variation of 1.0 to 10.0% and an island component diameter of 10 to 1,000 nm are disposed around a second island component (B) having an island component diameter of 1,000 to 4,000 nm, and 2) the second island components are fixed uniformly such that a coefficient of variation of intervals between centers of island components B is 1.0 to 20.0%.

2. A mixed yarn made by removing the sea component from the sea-island composite fiber according to claim 1.

3. A fiber product made from the mixed yarn according to claim 2.

4. A fiber product made from the sea-island composite fiber according claim 1.

* * * * *